US005871850A

United States Patent [19]

Moriguchi et al.

[11] Patent Number: 5,871,850

[45] Date of Patent: Feb. 16, 1999

[54] COATED HARD METAL MATERIAL

[75] Inventors: Hideki Moriguchi; Akihiko Ikegaya; Nobuyuki Kitagawa; Katsuya Uchino, all of Itami, Japan

[73] Assignee: Sumitomo Electric Industries, Ltd., Osaka, Japan

[21] Appl. No.: 652,496

[22] PCT Filed: Oct. 2, 1995

[86] PCT No.: PCT/JP95/02016

§ 371 Date: Jun. 3, 1996

§ 102(e) Date: Jun. 3, 1996

[87] PCT Pub. No.: WO96/10658

PCT Pub. Date: Apr. 11, 1996

[30] Foreign Application Priority Data

Oct. 4, 1994 [JP] Japan ..... 6-264574
Oct. 4, 1994 [JP] Japan ..... 6-264575

[51] Int. Cl.[6] ..... B32B 15/10; B24D 3/24; C04B 35/01

[52] U.S. Cl. ..... 428/651; 428/332; 428/698; 428/699; 428/701; 428/655; 428/657; 407/119; 51/309; 501/87

[58] Field of Search ..... 407/119; 427/249; 51/307, 309, 295; 501/87, 93, 153; 428/698, 699, 701, 336, 432, 457, 332, 651, 655, 657

[56] References Cited

U.S. PATENT DOCUMENTS

| | | | |
|---|---|---|---|
| Re. 32,111 | 4/1986 | Lambert et al. | 428/212 |
| 4,357,382 | 11/1982 | Lambert et al. | 428/212 |
| 4,525,415 | 6/1985 | Porat | 428/216 |
| 4,696,352 | 9/1987 | Buljan et al. | 175/57 |
| 4,714,660 | 12/1987 | Gates, Jr. | 428/698 |
| 4,749,629 | 6/1988 | Sarin et al. | 428/698 |
| 4,984,940 | 1/1991 | Bryant et al. | 407/119 |
| 5,071,693 | 12/1991 | Sue et al. | 428/212 |
| 5,075,181 | 12/1991 | Quinto et al. | 428/698 |
| 5,185,211 | 2/1993 | Sue et al. | 428/472 |
| 5,443,892 | 8/1995 | Holcombe et al. | 428/216 |
| 5,487,625 | 1/1996 | Ljungberg et al. | 407/119 |

FOREIGN PATENT DOCUMENTS

| | | |
|---|---|---|
| 52-43188 | 10/1977 | Japan . |
| 54-28316 | 3/1979 | Japan . |
| 56-52109 | 12/1981 | Japan . |
| 2-236268 | 9/1990 | Japan . |
| 4-341580 | 11/1992 | Japan . |
| 5-49750 | 7/1993 | Japan . |
| 6-15714 | 3/1994 | Japan . |
| 6-106402 | 4/1994 | Japan . |
| 7-305181 | 11/1995 | Japan . |

*Primary Examiner*—John J. Zimmerman
*Assistant Examiner*—Michael LaVilla
*Attorney, Agent, or Firm*—W. F. Fasse; W. G. Fasse

[57] ABSTRACT

A coated hard metal for a cutting tool is excellent in wear resistance and chipping resistance. The coated hard metal includes a hard coating layer on a surface of a base material of cemented carbide or cermet. The hard coating layer includes an inner layer (2) on the base material (1), an intermediate layer (3) on the inner layer (2) and an outer layer (4) on the intermediate layer (3). The inner layer (2) consists of a carbide, a nitride, a carbo-nitride, a carbo-oxide, a carbonitrogen oxide or a boronitride of Ti. The intermediate layer (3) consists of $Al_2O_3$ or $ZrO_2$. The outer layer (4) consists of a carbide, a nitride, a carbo-nitride, a carbo-oxide, a carbonitrogen oxide or a boronitride of Ti. The thickness of the inner layer (2) is 0.1 to 5 $\mu$m, the thickness of the intermediate layer (3) is 5 to 50 $\mu$m in the case of it being an $Al_2O_3$ layer and 0.5 to 20 $\mu$m in the case of it being a $ZrO_2$ layer, and the thickness of the outer layer (4) is 5 to 100 $\mu$m.

27 Claims, 4 Drawing Sheets

COATED HARD METAL MATERIAL

FIELD OF THE INVENTION

This application is a PCT 371 international application, having application Ser. No. PCT/JP95/02016, filed 2 Oct., 1995.

The present invention relates to a coated hard metal material prepared by coating cemented carbide or cermet with a hard material, and more particularly, it relates to a coated hard metal material which is employed for a cutting tool. The present invention provides a cutting tool material which is excellent in wear resistance and chipping resistance, and can withstand a high-speed or high-efficiency cutting condition, in particular.

BACKGROUND INFORMATION

It is known that a cutting edge temperature of a cutting tool during cutting exceeds about 800° C. at the maximum even under an ordinary cutting condition with a cutting rate of about 100 to 300 m/min. Further, in recent years, manufacturers who use machining operations, such as especially a car manufacturer, have increased the demand for development of a tool which can be used for cutting under a condition of a higher speed or a higher feed rate than the conventional one, such as a high speed of at least 300 m/min., for example, in order to improve productivity per unit time, in consideration of the, speed of NC machine tools, to reduce the production cost, and to achieve shorter working hours.

However, the cutting edge temperature of the cutting tool exceeds 1000° C. in such a cutting condition, and this is an extremely severe condition for the tool material. If the cutting edge temperature is increased, the cutting edge is plastically deformed by heat, to cause regression of the cutting edge position. At a temperature exceeding 1000° C., further, the base material such as cemented carbide forming the tool is oxidized and wear abruptly progresses.

In order to avoid such damage of the tool caused by cutting, tools are used that have been prepared by forming various types of hard coating layers on surfaces of hard metals by chemical vapor deposition or physical vapor deposition. Historically, a tool coated with a Ti compound first appeared, and improvement of the cutting speed was attained since the same is superior in stability under a high temperature as compared to cemented carbide. Thereafter a tool prepared by further coating a Ti compound with an $Al_2O_3$ layer of 1 to 2 $\mu$m thickness was developed to make it possible to further improve the cutting speed, and hence this forms the mainstream of the current coated cutting tool.

$Al_2O_3$ has a small standard formation free energy, and is chemically more stable than the Ti compound. Thus, it is said that an $Al_2O_3$ film brings a great effect for suppression of crater wear in a cutting face portion that is heated to the highest temperature in the cutting edge, and is suitable for high-speed cutting. Further it is said that propagation of cutting heat is suppressed and a hard metal material of the tool base can be kept at a low temperature since heat conductivity of $Al_2O_3$ is small. In order to develop a tool which is capable of higher speed cutting, therefore, it is expected that the $Al_2O_3$ layer may be further thickened.

When the $Al_2O_3$ layer is thickened, however, hardness is reduced since bulking of crystal grains forming the coating layers progresses, and a reduction of wear resistance on the flank comes into question. It has been recognized that, if such a tool is used in practice, the dimensions of the workpiece being cut are changed by regression of the cutting edge position since the progress of wear is quick, and the life of the tool is extremely short.

On the other hand, a method of preventing bulking of crystal grains by dividing an $Al_2O_3$ layer into plural layers is proposed in Japanese Patent Publication No. 5-49750. According to this method, the grain size of $Al_2O_3$ can certainly be reduced and wear resistance can be improved. On the other hand, boundaries between $Al_2O_3$ and other materials are increased, and hence separation at the interfaces easily takes place. In using such a tool for cutting with a large impact such as intermittent cutting, it has generally occurred that damage is abruptly increased due to layer separation in the flank and the cutting face, which abruptly reaches the end of or terminates the tool life.

Japanese Patent Publication No. 6-15714, on the other hand, proposes a coated sintered alloy prepared by coating with an $Al_2O_3$ layer while dividing the same into an inner layer of 1 to 3 $\mu$m thickness and an outer layer of 0.4 to 20 $\mu$m thickness. Both heat insulation and wear resistance are expected as the roles of the $Al_2O_3$ film of the outer layer. However, the function of the outer layer as an adiabatic layer is reduced by wear in an early stage, while no specific advice or consideration is given as to wear resistance of the outer layer either. Thus, progress of wear is quick, and the life of the tool was extremely short.

A technique of employing a $ZrO_2$ film whose standard formation free energy is small similarly to $Al_2O_3$ with smaller heat conductivity than $Al_2O_3$ is also proposed in Japanese Patent Publication No. 52-43188 or Japanese Patent Publication No. 54-34182.However, no tool employing $ZrO_2$ as a coating layer has been put into practice up to now. This is because a $ZrO_2$ layer is inferior in wear resistance since the hardness of $ZrO_2$ is low as compared with $Al_2O_3$.

Japanese Patent Publication No. 56-52109 discloses a technique of successively coating a cutting tip of cemented carbide with three layers of a lower layer, an intermediate layer and an upper layer. The lower layer is any one of titanium carbide, titanium nitride and titanium carbo-nitride of 1.0 to 10.0 $\mu$m in thickness, the intermediate layer is aluminum oxide of 0.1 to 5.0 $\mu$m in thickness, and the upper layer is any one of titanium carbide, titanium nitride and titanium carbo-nitride of 0.1 to 3.0 $\mu$m in thickness. This publication describes that the thickness of the intermediate layer must not exceed 5.0 $\mu$m since toughness is reduced if the intermediate layer exceeds 5 $\mu$m. Further, the publication describes that the thickness of the upper layer must not exceed 3.0 $\mu$m since crystal grains forming the coating layers are bulked when the thickness of the upper layer exceeds 3.0 $\mu$m and this is not preferable.

Japanese Patent Laying-Open No. 54-28316 also discloses a technique of forming coating layers of a three-layer structure on cemented carbide. The coating outermost layer consists of a nitride and/or a carbo-nitride of at least any one of Ti, Zr and Hf, the intermediate layer consists of $Al_2O_3$ and/or $ZrO_2$, and the coating innermost layer consists of a carbide and/or a carbonitride of at least any one of Ti, Zr and Hf. In its concrete example, the thickness of the innermost layer is 3 $\mu$m, the thickness of the intermediate layer is 1 $\mu$m, and the thickness of the outermost layer is 2 $\mu$m. The thickness of the outermost layer is not more than the thickness of the innermost layer.

The conventional coated hard metal material having these three-layer coatings is characterized in that it has the coating of TiN or TiCN in a thickness of not more than 3 $\mu$m on the oxide layer. However, when a cutting tip made of such a conventional coated hard metal material is employed in high-speed cutting, particularly in such cutting conditions in which the cutting edge temperature exceeds 800° C., there have been such problems that the cutting edge of the tip is easily damaged, and dimensional change of the workpiece easily takes place. This can also be read from the description of the aforementioned publication in that the outermost layer is oxidized in high-speed/high-feed cutting and an oxide such as $Al_2O_3$ or $ZrO_2$ is directly exposed.

SUMMARY OF THE INVENTION

An object of the present invention is to solve the aforementioned problems, and provide a coated hard metal material, especially for a cutting tool, which is excellent in wear resistance and chipping resistance.

Another object of the present invention is to provide a coated hard metal material for a cutting tool which can sufficiently withstand usage not only in an ordinary cutting condition but under such a severe cutting condition of a high speed or high efficiency that the cutting edge temperature exceeds 1000° C.

The present invention provides a coated hard metal material in which hard coating layers are provided on a surface of a base material selected from the group consisting of cemented carbide and cermet. In the present invention, the hard coating layers comprise the following three layers:

(a) an inner layer which is formed on the base material, and consists essentially of at least one layer of a material selected from the group consisting of a carbide, a nitride, a carbonitride, a carbo-oxide, a carbo-nitrogen oxide and a boronitride of Ti, (b) an intermediate layer which is formed on the inner layer, and is mainly composed of an oxide selected from the group consisting of $Al_2O_3$, $ZrO_2$ and a mixture or a solid solution thereof, and (c) an outer layer which is formed on the intermediate layer, and consists essentially of at least one layer of a material selected from the group consisting of a carbide, a nitride, a carbo-nitride, a carbo-oxide, a carbo-nitrogen oxide and a boronitride of Ti.

In the present invention, the thickness of the intermediate layer is at least 5 μm when the same is mainly composed of $Al_2O_3$, and at least 0.5 μm when the same is mainly composed of $ZrO_2$. The thickness of the outer layer is at least 5 μm, and exceeds the thickness of the inner layer.

In the present invention, the thickness of the inner layer is preferably in the range of 0.1 to 5 μm. The thickness of the intermediate layer is preferably in the range of 5 to 50 μm when the same is mainly composed of $Al_2O_3$, and preferably in the range of 0.5 to 20 μm when the same is mainly composed of $ZrO_2$. The thickness of the outer layer is preferably in the range of 5 to 100 μm.

In the present invention, the outer layer is made thicker than the inner layer, and the thickness of the outer layer is especially set to be at least 5 μm. Thus, the present invention can maintain good wear resistance for a longer time in cutting conditions from a low speed up to a high speed. Further, the present invention employs $Al_2O_3$ or $ZrO_2$ which is excellent in heat insulation for the intermediate layer. Particularly the intermediate layer suppresses propagation of heat which is generated in the cutting edge to the base material during cutting work, and suppresses plastic deformation of the base material caused by heat. When deformation of the base material in cutting work is suppressed, separation of the coating is also suppressed. In the present invention, the intermediate layer which is mainly composed of $Al_2O_3$ is at least 5 μm thick, and the intermediate layer which is mainly composed of $ZrO_2$ is at least 0.5 μm thick, as the thickness of the intermediate layer providing sufficient heat insulation. In the present invention, the inner layer particularly contributes to adhesion of the hard coating layers. onto the base material. On the other hand, the intermediate layer and the outer layer particularly contribute to heat insulation and wear resistance respectively. Thus, the present invention makes the three layers provide or carry out different functions respectively, for obtaining a coated hard metal material which can exhibit excellent performance in wide-ranging cutting conditions. Further, a superior result can be obtained by setting the thicknesses of the respective layers in proper ranges and/or improving adhesion between the respective layers, as described later.

BRIEF DESCRIPTION OF THE DRAWINGS

As shown in FIG. 1, an inner layer 2, an intermediate layer 3 and an outer layer 4 are successively formed on a base material 1.

DETAILED DESCRIPTION OF THE BEST MODE FOR CARRYING OUT THE INVENTION

Figure 1:
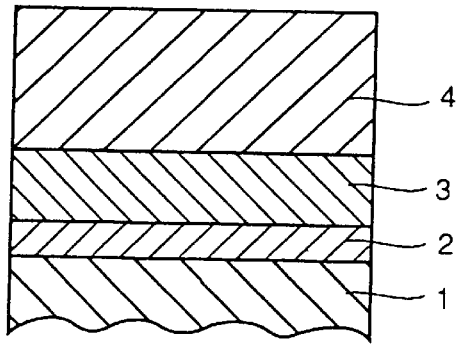
FIG. 1 is a schematic sectional view showing a concrete example of a coated hard metal material according to the present invention.

In the aforementioned conventional coated hard metal tool, the tool metal base material was coated with a Ti compound, and $Al_2O_3$ Of 1 to 2 μm in thickness was coated thereon. In the prior art, further, a thin TiN or TiCN layer of not more than 3 μm was formed on $Al_2O_3$. The total thickness of the coating layers was about 10 μm in the prior art. In the prior art, further, it is conceivable that the principal role of the outermost layer consisting of TiN or TiCN is identification of a used or worn corner by exhibiting a difference in coloring, and hence the outermost layer is thinner than the film thickness of the inner Ti compound as a matter of course, so that the same is readily worn. In the conventional coated hard metal having films of a three-layer structure, therefore, the outer TiN or TiCN film is worn in an early stage, and does not contribute to wear resistance. In the prior art, those layers contributing to wear resistance are the inner Ti compound layer and the $Al_2O_3$ layer.

In an environment where a coated hard metal tool is used in practice, a thermocouple was embedded in a tool and the temperature of a tool portion was examined. Consequently, it has been recognized, in relation to sectional temperature distribution of the tool cutting edge, that the temperature of the flank was lower by about 300° C. as compared with the maximum temperature of the cutting face, and the maximum temperature of the flank did not reach 1000° C. even in high-speed cutting with a cutting rate of 500 m/min. Further, wear resistance properties of a Ti compound, $Al_2O_3$ and $ZrO_2$ were compared with each other at respective cutting temperatures. Consequently, it has been recognized that $Al_2O_3$ or $ZrO_2$ is superior in wear resistance when the cutting temperature is at least 1000° C. on the flank while the Ti compound is superior in wear resistance under such a condition in which the cutting temperature of the flank is lower than 1000° C. Further, it has been proved that $Al_2O_3$ and $ZrO_2$ are more effective in suppression of crater wear than the Ti compound on the cutting face at a temperature of at least 600° C.

From these facts, it has been determined that the substance which is most excellent in wear resistance under a cutting condition, in which the maximum temperature of the cutting face reaches about at least 600° C. and not more than 1300° C., i.e., from a low speed cutting condition with a cutting rate of about 100 m/min. to a high-speed cutting condition with a cutting rate of about 500 m/min. is $Al_2O_3$ or $ZrO_2$ on the cutting face, and the Ti compound on the flank. As a coating structure in the coated hard metal, therefore, it has been determined that it is preferable that only the Ti compound is coated on the flank and only $Al_2O_3$ or $ZrO_2$ is coated on the cutting face. However, it is difficult to vary the deposition material on the different surfaces in case of forming hard coating layers by vapor deposition.

In the present invention, therefore, Al $_2O_3$ or $ZrO_2$ was coated on the inner side and a Ti compound was more thickly coated on the outer side, thereby improving wear resistance on the flank, to obtain a coated hard metal which can suppress cutting edge wear and deformation and accordingly also suppress dimensional change of a workpiece. As described above, the film thicknesses of the intermediate layer and the outer layer were set to be larger in the coated hard metal having the inner layer consisting essentially of a Ti compound, the intermediate layer consisting essentially of $Al_2O_3$ and/or $ZrO_2$ and the outer layer consisting essentially of a Ti compound, to obtain a tool material which is excellent in wear resistance and chipping resistance. When a thick Ti compound is coated on the outer side, a hard film having relatively low wear resistance can be formed inside the same. In relation to crater wear resistance, on the other hand, the oxide layer provided inside plays a role of reinforcing the outer Ti compound layer.

In high-speed cutting, particularly at such a cutting speed that the cutting edge temperature exceeds 800° C., most problematic is plastic deformation of the base material alloy. If such plastic deformation occurs, a hard coating layer consisting of ceramics having smaller deformability than the base material cannot follow the deformation, cracks are caused in the coating layer, the cracks become larger due to cutting stress, and a workpiece material becomes deposited thereon to readily cause separation of the layer. The prior art has not discovered a sufficient solution for this problem caused by plastic deformation.

As hereinabove described, further, the thickness of the outer layer is small at about 2 $\mu$m in the prior art, and hence the inner layer is readily exposed by wear of the outer layer. Thus, it has been difficult to suppress dimensional change of the workpiece caused by dimension change of the flank. Although the outer layer in the prior art is directed to a function of lubricity with respect to the workpiece such as steel, for example, particularly reactivity with steel on the cutting face, it has not aimed at improvement of wear resistance on the flank. According to the present invention, on the other hand, plastic deformation of the base material during cutting can be suppressed as compared with the prior art, by employing $Al_2O_3$ or $ZrO_2$ which is excellent in heat insulation as the intermediate layer. Therefore, separation of the coating layers is hardly caused in a cutting tool comprising the inventive coated hard metal. Further, the same is excellent in wear resistance on the flank by making the film thickness of the outer layer of a Ti compound thicker than the inner layer and coating or applying the same in a layer thickness in excess of 5 $\mu$m. According to the present invention, therefore, it is possible to provide a coated hard metal cutting tool which does not cause dimensional change of the workpiece due to wear or deformation of the tool, and which can suppress crater wear on the cutting face at the same time. These characteristics are achieved by the intermediate layer consisting essentially of $Al_2O_3$, $ZrO_2$ or a mixture thereof having a proper thickness, and the outer layer consisting essentially of a Ti compound which is thickly formed thereon.

In the coated hard metal of the present invention, the base material is cemented carbide or cermet, i.e., a hard metal consisting essentially of an iron family metal and carbides, nitrides and carbo-nitrides of the elements of the groups IVa, Va and VIa of the periodic table. Among the hard coated layers provided on this base material, the inner layer of a Ti compound acts as a layer bonding the base material with the intermediate layer of $Al_2O_3$ or $ZrO_2$, the intermediate layer of $Al_2O_3$ or $ZrO_2$ improves crater wear resistance and plastic deformation resistance on the cutting face, and the outer layer of a Ti compound which is coated more thickly than the inner layer contributes to improvement of wear resistance on the flank.

Therefore, a cutting tool comprising the coated hard metal of the present invention is excellent in wear resistance on the flank due to superior wear resistance of the Ti compound at temperatures of not more than 1000° C., reduces undesired dimensional change of the workpiece, and lengthens the tool life. On the cutting face portion which is heated to a higher temperature than the flank portion during cutting, further, excellent crater wear resistance can be expected even if the outer layer of the Ti compound is worn, since the intermediate layer of $Al_2O_3$ or $ZrO_2$ is present under the same. For the tool, wear on the cutting face is not so problematic unless the base material is exposed, and wear of the outer layer of the Ti compound in an initial stage causes no significant obstacle. Consequently, the cutting tool according to the present invention can exhibit excellent wear resistance in wide-ranging cutting conditions from a low speed up to a high speed.

Among the hard coating layers, the inner layer which is formed on the base material consists essentially of at least one layer of a material selected from the group consisting of a carbide, a nitride, a carbo-nitride, a carbo-oxide, a carbo-nitrogen oxide and a boronitride of Ti. The reason why these Ti compounds are employed as the inner layer resides in that the same are excellent in adhesion to the hard metal which is the base material, and also excellent in adhesive property with $Al_2O_3$ and $ZrO_2$ being the intermediate layer. Further, its film thickness is preferably in the range of 0.1 to 5 $\mu$m, and more preferably in the range of 0.5 to 3 μm, since its effect is not attained if the thickness is less than 0.1 μm in total, while the same is too thick as an adhesion layer if the thickness exceeds 5 μm.

The intermediate layer which is formed on the inner layer is mainly composed of $Al_2O_{31}$ $ZrO_2$, or a mixture or a solid solution thereof. When the mixture is employed, either of both is contained in a large quantity as a main component. In case of an intermediate layer mainly composed of $Al_2O_3$, another substance, such as $ZrO_2$, $HfO_2$, $TiO_2$, TiC or TiN may be contained in a ratio of not more than 50%, or Ti, Zr or Cl or N may be solidly dissolved in the intermediate layer in a ratio of not more than 50%. Further, the intermediate layer mainly composed of $Al_2O_3$ may be divided by another film, such as a thin film of a Ti compound such as TiC, TiCN, TiN, TiBN, TiCO or TiCNO, an Al compound such as AlN or AlNO, or an oxide such as $ZrO_2$, $HfO_2$ or $TiO_2$, for example.

The intermediate layer mainly composed of $Al_2O_3$ has a large effect of suppressing plastic deformation of the base material and improving crater wear resistance on the cutting face. In particular, an important effect is the suppression of film separation resulting from thermal deformation of the base material, which has been achieved by a heat insulation effect of this intermediate layer. However, the effect is small if its film thickness is less than 5 μm while strength is reduced if the thickness exceeds 50 μm, and hence the range of 5 to 50 μm is preferable, and more preferable is the range of 10 to 40 μm.

On the other hand, $ZrO_2$ has previously not been put into practice since the same is low in hardness and low in wear resistance, while its heat conductivity is extremely small as compared with $Al_2O_3$. $Al_2O_3$ has heat conductivity of 0.054 cal/cm·sec·° C. and $ZrO_2$ has heat conductivity of 0.005 cal/cm·sec·° C. at 20° C., while $Al_2O_3$ has heat conductivity of 0.015 cal/cm·sec·° C. and $ZrO_2$ has heat conductivity of 0.005 cal/cm·sec·° C. at 1000° C. Therefore, $ZrO_2$ is excellent in effect of suppressing plastic deformation of the base material, and a heat insulation effect substantially identical to that of $Al_2O_3$ is attained in a layer which is thinner than $Al_2O_3$.

Based on such recognition, a tool prepared by providing an intermediate layer of $ZrO_2$ on the thin inner layer of a Ti compound which was formed on a base material, and coating a thick outer layer of a Ti compound thereon was produced as a test sample, and a high-speed cutting test was executed. Consequently, it has been recognized that the tool having the coating structure of the present invention is superior in plastic deformation and superior in wear resistance on the flank as compared with a tool having the conventional coating structure. It has been proved that undesired dimensional change of a workpiece is hardly caused and crater wear on the cutting face can also be suppressed at the same time when cutting is performed by employing the tool according to the present invention.

Further, it has also been proved, even in comparison to the case of employing $Al_2O_3$ for the intermediate layer, taht the $ZrO_2$ intermediate layer cannot only attain excellent plastic deformation resistance with a thinner film but the film thickness can be reduced, whereby smoothness of the coating surface is improved and separation resistance is improved. To the inventor's surprise, further, an unexpected effect has been attained whereby boundary wear, which ordinarily comes into question in cutting of a readily work-hardened workpiece such as stainless steel, is reduced and chipping resistance is improved. Although the reason therefor is not clear, this is conceivably because the Young's modulus of $ZrO_2$ is small and its hardness is low and hence its deformability is large.

In case of employing the intermediate layer mainly composed of $ZrO_2$, another oxide such as $Al_2O_3$, $HfO_2$ or $TiO_2$, for example, TiC or TiN may be contained in a ratio of not more than 50%, or Al, Ti, Cl or N may be solidly dissolved in the intermediate layer in a ratio of not more than 50%. Further, the intermediate layer mainly composed of $ZrO_2$ may be divided by another film, such as a thin film of a Ti compound such as TiC, TiCN, TiN, TiBN, TiCO or TiCNO, a Zr compound such as ZrN or ZrC, or an oxide such as $Al_2O_3$, $HfO_2$ or $TiO_2$, for example. The intermediate layer mainly composed of $ZrO_2$ has a large effect of suppressing plastic deformation of the base material and improving crater wear resistance on the cutting face. In particular, an important effect has been achieved, whereby suppression of film separation resulting from deformation of the base material has been enabled by this intermediate layer. However, the effect is small if its film thickness is less than 0.5 μm while strength is reduced if the thickness exceeds 20 μm, and hence the range of 0.5 to 20 μm is preferable, and more preferable is the range of 3 to 15 μm.

Figure 2A:
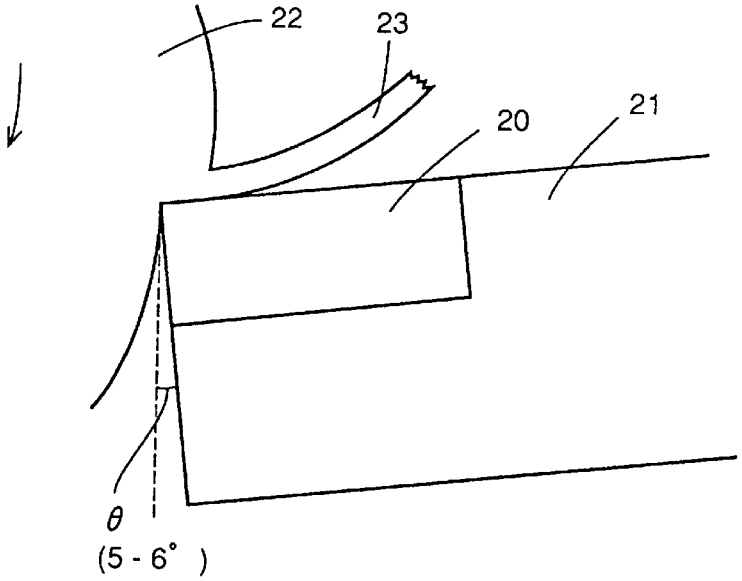
FIG. 2A is a typical side view diagram showing a state of working or cutting a workpiece with a cutting tool. A workpiece 22 is cut with a cutting tool 20 which is mounted on a holder 21, whereby a chip 23 is caused. The cutting tool 20 is used at a clearance angle θ.
Figure 2B:
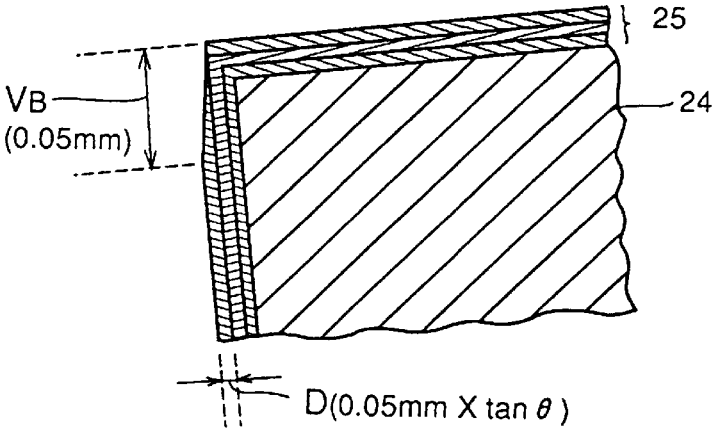
FIG. 2B is a schematic sectional view showing wear of a cutting tool. This figure shows a worn thickness D of a film 25 on a tool base material 24 in an abrasion loss area $V_B$.

The outer layer which is formed on the intermediate layer consists essentially of at least one layer of a material selected from the group consisting of a carbide, a nitride, a carbonitride, a carbo-oxide, a carbonitrogen oxide and a boronitride of Ti, and effectively improves wear resistance on the flank. The reason why the film thickness of the outer layer is set to be at least 5 μm is now described. When the inventors collected used tools in a steel part machining line of a car manufacturer and investigated damaged states of the tools, they confirmed that almost all the tools exhibited flank wear of at least 0.05 mm. A cutting tool is used at a clearance angle θ of 5 ° to 60 ° as shown in FIG. 2A, and hence the abrasion wear $V_B$ of 0.05 mm corresponds to a film thickness of about 5 μm (0.05 mm×tan6°) that is worn at the maximum, as shown in FIG. 2B. Therefore, the lower layer or the base material which is inferior in wear resistance will be exposed and the tool will tend to have a short life unless a film of at least 5 μm thickness which is excellent in wear resistance is provided on the tool surface. Therefore, it is necessary to employ a Ti compound film exhibiting excellent wear resistance at cutting speeds of 100 m/min. to 500 m/min. as the outer layer and to coat the same in excess of 5 μm thickness. However, strength is reduced if 100 μm thickness is exceeded, and hence the film thickness is preferably in the range of 5 to 100 μm. In such a cutting condition that the cutting speed exceeds 300 m/min., a film thickness of at least 10 μm is particularly preferable, and the range of 15 to 50 μm is more preferable.

In case of employing the intermediate layer mainly composed of $Al_2O_3$, the total of the film thicknesses of the hard coating layers is preferably in the range of 25 to 60 μm. in this range, it is possible to more effectively protect the base material, and to attain further excellent chipping resistance. In case of the intermediate layer mainly composed of $ZrO_2$, on the other hand, the total of the film thicknesses of the hard coating layers is preferably in the range of 20 to 60 μm. In this range, the base material is more effectively protected, and more excellent chipping resistance is attained.

It has been proved that, in case of directly coating a Ti compound on the intermediate layer of $Al_2O_3$, it is difficult to make the film thickness of the outer Ti compound larger since adhesion between both is low. In the present invention, it is preferable to further provide a thin film between the intermediate layer of $Al_2O_3$ and the outer layer. This film is formed in direct contact with the intermediate layer, and a film thickness of 0.1 to 2 μm is preferable. This thin film can be an Al-containing thin film consisting essentially of a material which is selected from the group consisting of a nitride and an oxy-nitride of Al. In case of employing such an Al-containing thin film, it is more preferable that the nitrogen content in the thin film is reduced as the film approaches the intermediate layer, and the oxygen content is increased as the film approaches the intermediate layer. This thin film improves the adhesion between the $Al_2O_3$ intermediate layer and the outer layer of the Ti compound. Due to this thin film, separation between the layers hardly takes place, and excellent wear resistance is attained. In particular, the adhesion between the intermediate layer and the outer layer is further increased by continuously changing the composition of the thin film between $Al_2O_3$ and AlN or AlON as described above, so that separation is even less likely to take place.

In case of the intermediate layer mainly composed of $ZrO_2$, on the other hand, it is preferable to further form a Zr-containing thin film consisting essentially of a material which is selected from the group consisting of a carbide, a nitride, a carbo-nitride, a carbo-oxide, an oxy-nitride and a carbonitrogen oxide of Zr between the intermediate layer and the outer layer. The thickness of this thin film is preferably 0.1 to 2 μm. Due to this thin film, adhesion between the intermediate layer and the outer layer is increased, and a thicker outer layer can be formed. Due to excellent adhesion, further, separation between the layers hardly takes place, and excellent wear resistance can be attained. Also in this Zr-containing film, it is preferable that the nitrogen content and/or the carbon content is reduced as the film approaches the intermediate layer and the oxygen content is increased as the film approaches the intermediate layer. Thus, more excellent adhesion is attained and separation of the layers can be more effectively suppressed, by continuously changing the composition between $ZrO_2$ and the Zr compound.

Figure 3:
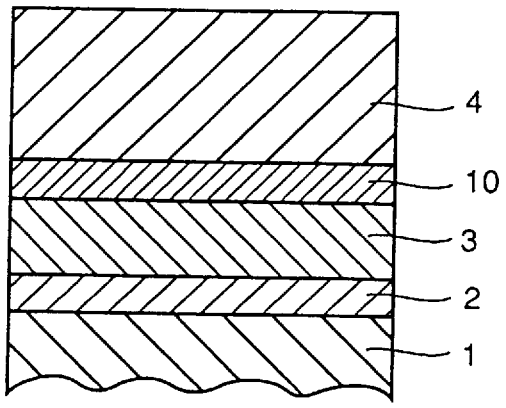
FIG. 3 is a schematic sectional view showing another concrete example of the coated hard metal material according to the present invention.

A structure of further forming a thin film between an intermediate layer and an outer layer is shown in FIG. 3. Referring to FIG. 3, an inner layer 2 is formed on a base material 1, and an intermediate layer 3 is formed thereon. The intermediate layer 3 is tightly bonded to an outer layer 4 through an Al- or Zr-containing thin film 10.

Figure 4:
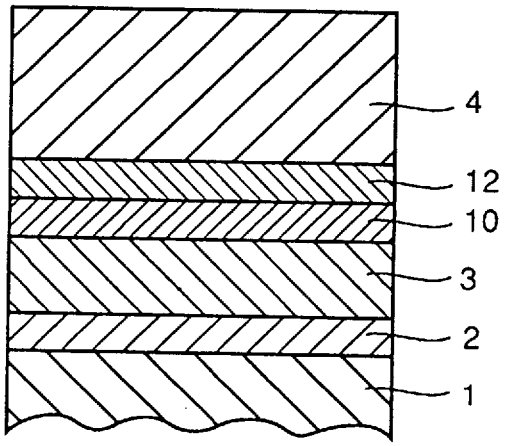
FIG. 4 is a schematic sectional view showing still another concrete example of the coated hard metal material according to the present invention.

As shown in FIG. 4, on the other hand, a thin film may be further formed between an intermediate layer 3 and an outer layer 4, in addition to the Al- or Zr-containing thin film. In such a coating, therefore, the inner layer 2 is formed on the base material 1, and the intermediate layer 3 is formed thereon. The Al- or Zr-containing thin film 10 is formed on the intermediate layer 3. The Al- or Zr-containing thin film 10 is tightly bonded to the outer layer 4 through a thin film 12. Such a thin film 12 can be made of a material selected from the group consisting of TiBNO, TiNO and $TiO_2$.

Figure 5:
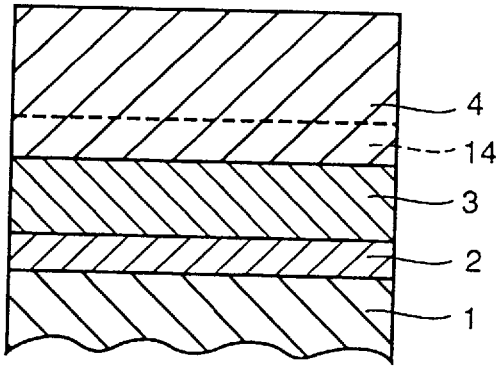
FIG. 5 is a schematic sectional view showing a further concrete example of the coated hard metal material according to the present invention.

On the other hand, a thin film consisting essentially of a material which is selected from the group consisting of TiBN, TiCO and TiCNO can be employed in place of the Al- or Zr-containing layer, in order to improve adhesion between the intermediate layer and the outer layer. Such a thin film may be a part of the outer layer defined in the above. A structure employing this thin film is shown in FIG. 5. The inner layer 2 is formed on the base material 1, and the intermediate layer 3 is formed thereon. The intermediate layer 3 is tightly bonded to the outer layer 4 through a thin film 14 consisting essentially of TiBN, TiCO or TiCNO. Stronger adhesion is attained by employing such a material as a portion of the outer layer which comes into contact with the intermediate layer.

Figure 6:
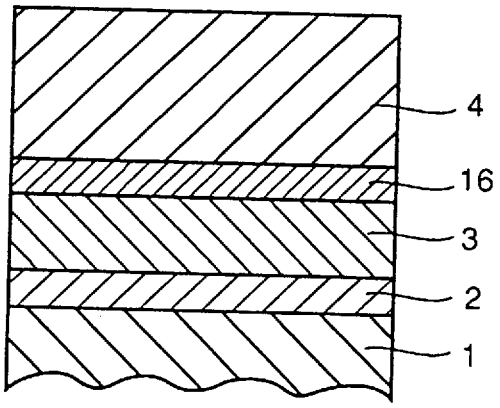
FIG. 6 is a schematic sectional view showing a further concrete example of the coated hard metal material according to the present invention.

It is also possible to provide a thin film consisting essentially of a material which is selected from the group consisting of TiBNO, TiNO and $TiO_2$ between the intermediate layer and the outer layer, in contact with the intermediate layer. A structure employing such a thin film is shown in FIG. 6. The inner layer 2 is formed on the base material 1, and the intermediate layer 3 is formed thereon. The intermediate layer 3 is tightly bonded to the outer layer 4 through a thin film 16. The thin film 16 can be a thin film of TiBNO, TiNO, or $TiO_2$. The thickness of this film is preferably in the range of 0.1 to 2 μm.

Further, it has been proved that chipping resistance is improved when the outer layer is mainly composed of columnar crystals, and hence this is preferable. When hard coating layers are deposited on the base material by chemical vapor deposition or the like, tensile residual stress is caused on the coating layers due to the difference between the thermal expansion coefficients of the base material and the coating layers and hence chipping resistance of the tool is generally reduced. However, it has been presumed that, when the outer layer 4 is mainly composed of columnar crystals 5 as shown in FIG. 7, tensile residual stress is readily released in that cracks 6 are caused in grain boundaries of the columnar crystals 5, which thereby avoids the formation of large cracks or chipping reaching the other deeper layers and thus affecting the tool life.

Figure 7:
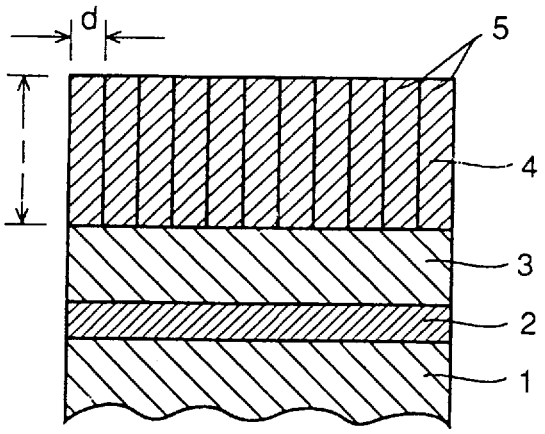
FIG. 7 is a schematic sectional view showing a further concrete example of the coated hard metal material according to the present invention. In this material, an outer layer consists essentially of columnar crystals.
Figure 8:
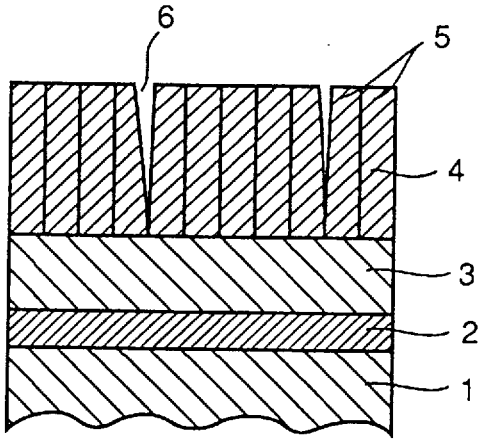
FIG. 8 is a schematic sectional view showing a state in which cracks are caused in the columnar crystals of the outer layer in the coated hard metal material according to the present invention as shown in FIG. 7.

Therefore, it is possible to increase the film thickness of the outer layer 4 by making the outer layer 4 of the columnar crystals 5 in the inventive coated hard metal, providing an inner layer 2 of a Ti compound on a base material 1, providing the intermediate layer 3 mainly composed of $Al_2O_3$ or $ZrO_2$ thereon, and providing the outer layer 4 of a Ti compound further thereon as shown in FIG. 7, so that further excellent wear resistance can be exhibited over a long period.

When the aspect ratio of the columnar crystals 5 is in the range of 5 to 80, improvement of wear resistance and chipping resistance is particularly remarkable. Here, the aspect ratio is the ratio 1/d of the length 1 of the columnar crystals 5 to the crystal grain diameter d, as shown in FIG. 7. Its measurement was performed by photographing a section of the hard coating layer by TEM, and obtaining an average value of three arbitrary visual fields.

Particularly when the outer layer consists essentially of TiCN in the form of columnar crystals, wear resistance on the flank and chipping resistance are more excellent. Above all, particularly excellent wear resistance is attained when the C:N molar ratio of the TiCN is in the range of 5:5 to 7:3. This is because hardness and toughness of the coating layer is well-balanced to exhibit excellent wear resistance and chipping resistance when the C:N ratio of TiCN is in this range. The molar C:N ratio can be measured by obtaining the lattice constant of the TiCN outer layer by analysis through ESCA (ELECTRON SPECTROSCOPY FOR CHEMICAL ANALYSIS) or EPMA (ELECTRON PROBE MICRO ANALYSIS), or X-ray analysis.

According to a result obtained by the inventors through X-ray analysis, the lattice constant of TiCN having a molar C:N ratio within the range of 5:5 to 7:3 was in the range of 4.275 to 4.295, and particularly excellent wear resistance and chipping resistance were exhibited at this time. While this result includes deviation in consideration of or in comparison to TiCN of a stoichiometric composition, it seems that such deviation has been caused since the particular TiCN may have a nonstoichiometric composition such as $Ti(CN)_{0.9}$, for example.

Further, TICN of the outer layer preferably has maximum peak strength of X-ray diffraction, as to a crystal plane selected from the group consisting of (111), (422) and (311). A TiCN film of the outer layer exhibiting such characteristics is excellent in adhesion with the lower layer.

Among the hard coating layers, the thickest layer which is included in the inner layer preferably consists essentially of a layer mainly composed of columnar crystals having an aspect ratio in the range of 5 to 30. Such an inner layer can have high strength. When the aspect ratio is set in this range in case of thickening the inner layer, strength reduction of the inner layer can be suppressed.

On the other hand, the intermediate layer preferably includes a layer mainly composed of columnar crystals having an aspect ratio in the range of 3 to 20. The strength and toughness of the intermediate layer do not depend on the grain size alone, but also depend on the aspect ratio of the crystal grains. The inventors have discovered that the strength and toughness can be improved by making the aspect ratio of the crystal grains in the intermediate layer fall within the range of 3 to 20. Further, the inventors have discovered that the degree of bulking of the crystal grains is small and the aspect ratio of the crystal grains can be increased even if the film of $Al_2O_3$ or $ZrO_2$ is thickened. Also, it has been proved that a film which is excellent in strength and toughness can rather be obtained by thickening the film.

It is more preferable that the $Al_2O_3$ Of the intermediate layer is mainly composed of $\alpha$-$Al_2O_3$. A crystal grain having an aspect ratio in the range of 3 to 20 can be readily formed by making the crystal system of $Al_2O_3$ an a type, and a film which is excellent in strength and toughness can be obtained. Further, the $\alpha$-$Al_2O_3$ film preferably has the maximum peak strength of X-ray diffraction as to a crystal plane which is selected from the group consisting of (104) and (116). Thus, adhesion between the outer layer and the $Al_2O_3$ film can he improved.

On the other hand, the crystal system of $Al_2O_3$ in the intermediate layer can be mainly composed of $\kappa$-$Al_2O_3$, in and near a portion thereof, which is in contact with the inner layer and in and near a portion thereof which is in contact with the outer layer. The adhesion between the inner and outer layers and the intermediate layer can be improved by providing $\kappa$-$Al_2O_3$ in the portions which are in contact with the outer layer and the inner layer respectively. Further, an intermediate layer which is excellent in strength and toughness and excellent in adhesion can be obtained by forming an intermediate layer having $\alpha$-$Al_2O_3$ portions between $\kappa$-$Al_2O_3$ portions.

The inventors have discovered that particularly excellent separation resistance and chipping resistance can be provided by controlling the distances between cracks which are formed on the hard coating layers at proper values. Namely, the average of the distances between adjacent cracks is preferably 20 to 40 $\mu$m, in relation to a plurality of cracks which are formed on the hard coating layers. Further, the distances between cracks in the inner layer and in the outer layer are preferably smaller than those between cracks in the intermediate layer. Excellent chipping resistance and wear resistance can be attained by thus controlling the distribution state of the cracks. Particularly in a coating having a thickness of at least 25 $\mu$m, the effect of controlling the distances between the cracks in this range is remarkable. Due to such control of the distances between the cracks, it has now been made possible to employ a coated hard metal having thicker films that were previously generally regarded as unemployable.

The inner layer, the intermediate layer and the outer layer according to the present invention can be formed by ordinary chemical vapor deposition or physical vapor deposition. In case of forming the outer layer of TiCN on the intermediate layer of $Al_2O_3$ or $ZrO_2$ by chemical vapor deposition, TiCN can be coated at a temperature of 700° to 1100° C. with a pressure of not more than 500 Torr while employing $TiCl_4$ as a raw material gas to provide a source of Ti, an organic carbo-nitride as a carbon and nitrogen source, and hydrogen gas as a carrier gas. According to such a step, homogeneous and fine nucleation of TiCN is performed on $Al_2O_3$ or $ZrO_2O_2$, whereby a hard coating layer can be obtained which is excellent in adhesion with the intermediate layer, hardly causes interlayer separation, and exhibits excellent wear resistance.

When an organic carbo-nitride such as $CH_3CN$, for example, is employed as a carbon and nitrogen source in the aforementioned method, in particular, the crystal grains of the TiCN outer layer can be readily brought into the state of columnar crystals, it is easy to increase the aspect ratio of the columnar crystals, and the TiCN outer layer having a molar C:N ratio within the range of 5:5 to 7:3 can be readily formed.

In the coated hard metal of the present invention, further, a film of an oxide which is selected from the group consisting of $Al_2O_3$, $ZrO_2$ and $HfO_2$ can be coated on the outer layer in a thickness of 0.5 to 5 $\mu$m in total. Boundary wear and deterioration of the Ti compound film in portions other than a worn portion can be prevented by covering the outer layer with such a film. Particularly an effect of suppressing boundary wear was remarkable in cutting of a generally uncuttable material such as stainless steel. The effect is small if the thickness of this film is smaller than 0.5 $\mu$m, and wear resistance on the flank is reduced if the same is larger than 5 $\mu$m. In particular, the range of the thickness is preferably 1 to 3 $\mu$m. Further, this film is preferably thinner than the intermediate layer. A thin film of TiN or ZrN exhibiting a golden color may be coated on the outermost surface of the coated hard metal of the present invention. This is because these golden colors are useful for identification of used or worn corners.

The coated hard metal of the present invention can be employed for a cutting tool. Therefore, the coated hard metal of the present invention can have the shape of a cutting tool such as a cutting tip, for example. In the cutting edge of a cutting tool which is formed by the coated hard metal of the present invention, it is more preferable that parts of the hard coating layers are removed, and a surface whose average value of surface roughness Ra is not more than 0.05 $\mu$m is formed. A cutting tool which is excellent in wear resistance can be provided by forming such a smooth surface on a portion of the cutting edge.

While embodiments of the present invention are now shown in Examples, the present invention is not restricted by these Examples.

EXAMPLE 1

ISO M20 cemented carbide (base material 1), ISO K20 (base material 2) and a commercially available cermet tool material (base material 3) were prepared as base materials, and each one of hard coating layers shown in Table 1 was formed on each base material by well-known chemical vapor deposition at a deposition temperature of 1000° C., to prepare tip-shaped tools according to SNGN120408 respectively.

TABLE 1

| Symbol | Structure of Hard Coating Layer (left side = base material side, number in parentheses = film thickness (μm) |
|---|---|
| A | TiN(0.5)/$Al_2O_3$(10)/TiCN(15) |
| B | TiC(0.5)/TiCN(3)/TiBN(0.5)/$Al_2O_3$(5)TiN(7) |
| C | TiCN(2)/TiCO(0.5)/$Al_2O_3$(20)/TiCN(20) |
| D | TiN(0.5)/TiCNO(0.5)/$Al_2O_3$(45)ITiCN(30)/TiC(10) |
| E | A1203(10)/TiCN(15) |
| F | TiN(0.5)/$Al_2O_3$(2)/TiCN(15) |
| G | TiN(0.5)/TiCN(15)/$Al_2O_3$(10) |
| H | TiN(0.5)/$Al_2O_3$(10) |
| I | TiN(1)/TiBN(0.5)/$Al_2O_3$(10)/TiC(0.5)/TiCN(10) |

(Note)
In relation to the structures of the hard coating layers in Table 1, the fact that the left sides are base material sides and the numbers in parentheses indicate film thicknesses (μm) also applies to the following Tables.

(Note) In relation to the structures of the hard coating layers in Table 1, the fact that the left sides are base material sides and the numbers in parentheses indicate film thicknesses (μm) also applies to the following Tables.

The respective tips having the hard coating layers formed on the base materials were employed for cutting workpieces of SCM415 under cutting conditions shown in the following Table 2, and cutting performance was evaluated. The results are shown in Table 3, along with the combinations of the base materials and the hard coating layers.

TABLE 2

| Cutting Condition | Cutting Speed (m/min) | Feed Rate (mm/rev) | Depth of Cut (mm) | Cutting Oil | Holder | Life Criterion |
|---|---|---|---|---|---|---|
| 1 | 500 | 0.5 | 1.5 | no | FN11R44A | $V_B$ = 0.15 mm |
| 2 | 200 | 0.4 | 1.5 | yes | FN11R44A | $V_B$ = 0.15 mm |
| 3 | 100 | 0.3 | 1.5 | no | FN11R44A | chipping |

TABLE 3

| Sample | Base Material | Coating Layer | Cutting Performance: Cutting Condition 1 | Cutting Performance: Cutting Condition 2 |
|---|---|---|---|---|
| 1 | 1 | A | 5 min. 11 sec. | 102 min. 17 sec. |
| 2 | 2 | B | 4 min. 23 sec. | 61 min. 27 sec. |
| 3 | 3 | C | 9 min. 8 sec. | 89 min. 46 sec. |
| 4 | 1 | D | 18 min. 39 sec. | 73 min. 51 sec. |
| 5* | 1 | E | separated in 19 sec. | separated in 2 min. 14 sec. |
| 6* | 1 | F | chipped in 45 min. | 87 min. 35 sec. |
| 7* | 1 | G | 1 min. 56 sec. | 29 min. 7 sec. |
| 8* | 1 | H | 2 min. 4 sec. | 16 min. 29 sec. |

*indicates a comparative example in all Tables.

From the above results, it is understood that the tips of the samples 1 to 4 of inventive Example exhibit excellent cutting performance not only in high-speed cutting (cutting condition 1) but also in low-speed cutting (cutting condition 2). By comparison of the samples 1 and 5, an effect of having a Ti compound as an inner layer is understood. From comparison of the samples 1 and 6, it is understood that the improved effect is small if the film thickness of the $Al_2O_3$ intermediate layer is 2 μm, while it is understood by comparison of the samples 1 and 7 that $Al_2O_3$ is superior in wear resistance when the same is employed as an intermediate layer rather than being coated as an outer layer. By comparison of the samples 1 and 8, it is understood that the Ti compound is superior in wear resistance to $Al_2O_3$ as an outer layer.

EXAMPLE 2

Figure 9:
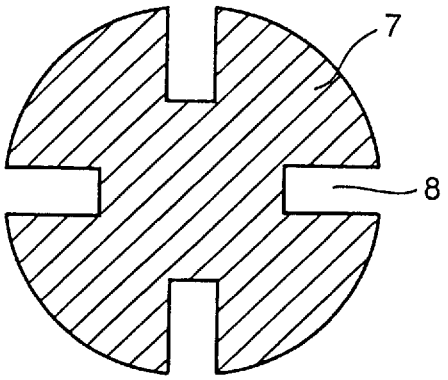
FIG. 9 is a schematic sectional view of a workpiece employed for a chipping resistance test of an Example of the invention.

Hard coating layers shown in the following Table 4 were formed on surfaces of the base materials 1 in the above Example 1, to prepare tips of samples 9 to 14. These tips were employed for evaluating cutting performance under the cutting condition 2 similarly to Example 1. A workpiece 7 consisting of SCM435 having four grooves 8 on its circumference as shown in FIG. 9 was employed for testing chipping resistance under the cutting condition 3 of the above Table 2. The chipping resistance was evaluated by cutting times up to chipping of the tips. These results are shown together in Table 4.

TABLE 4

| Sample | Structure of Hard Coating Layer | Wear Resistance Cutting Condition 2 | Chipping Resistance Cutting Condition 3 |
|---|---|---|---|
| 9* | $Al_2O_3$(10)/TiCN(15) | Separated in 1 min. 38 sec. | 2 min.50 sec. |
| 10 | TiC(0.2)/$Al_2O_3$(10)/TiCN(15) | 65 min. 51 sec. | 4 min. 29 sec. |
| 11 | TiC(0.5)/$Al_2O_3$(10)/TiCN(15) | 89 min. 33 sec. | 5 min. 41 sec. |
| 12 | TiC(3)/$Al_2O_3$(10)/TiCN(15) | 115 min. 45 sec. | 5 min. 12 sec. |
| 13 | TiC(5)/$Al_2O_3$(10)/TiCN(15) | 93 min. 29 sec. | 4 min. 44 sec. |
| 14* | TiC(10)/$Al_2O_3$(10)/TiCN(15) | 87 min. 47 sec. | 3 min. 47 sec. |

As understood from the above results, the sample 9 having no Ti compound as an inner layer suffered separation of the coating layers in an early stage in a wear resistance test since adhesion of the coating layers was low, and had an extremely short life. The tip of the sample 14 exhibited a slightly inferior chipping resistance since the film thickness of the inner layer was large, while the same is excellent as to wear resistance. On the other hand, the samples 10 to 13 of inventive Example are excellent in wear resistance and chipping resistance, while the samples 11 and 12 are excellent in balance between wear resistance and chipping resistance in particular.

EXAMPLE 3

Hard coating layers shown in the following Table 5 were formed on surfaces of the base materials 2 in the above Example 1, to prepare tips of samples 15 to 21. These tips were employed for evaluating cutting performance by the cutting condition 1 similarly to Example 1. Similarly to Example 2, further, chipping resistance was tested by the cutting condition 3. These results are shown together in Table 5.

TABLE 5

| Sample | Structure of Hard Coating Layer | Wear Resistance Cutting Condition 1 | Chipping Resistance Cutting Condition 2 |
|---|---|---|---|
| 15* | TiCN(2)/$Al_2O_3$(0.5)/TiC(13) | Chipped in 1 min. 13 sec. | 6 min. 52 sec. |
| 16 | TiCN(2)/$Al_2O_3$(5)/TiC(13) | 9 min. 51 sec. | 7 min. 24 sec. |
| 17 | TiCN(2)/$Al_2O_3$(10)/TiC(13) | 12 min. 3 sec. | 7 min. 33 sec. |
| 18 | TiCN(2)/$Al_2O_3$(20)/TiC(13) | 12 min. 54 sec. | 6 min. 53 sec. |
| 19 | TiCN(2)/$Al_2O_3$(38)/TiC(13) | 12 min. 29 sec. | 5 min. 47 sec. |
| 20 | TiCN(2)/$Al_2O_3$(48)/TiC(13) | 10 min. 47 sec. | 3 min. 51 sec. |
| 21* | TiCN(2)/$Al_2O_3$(60)/TiC(13) | 10 min. 21 sec. | 2 min. 28 sec. |

As understood from the above results, the samples other than the sample 15 having a small film thickness of the intermediate layer of $Al_2O_3$ and the sample 21 having a large thickness exhibited cutting performance which is excellent in balance between wear resistance and chipping resistance, and the tips of the samples 17, 18 and 19 exhibited particularly excellent cutting performance above all.

EXAMPLE 4

Hard coating layers shown in the following Table 6 were formed on surfaces of the base materials 3 in the above Example 1, to prepare tips of samples 22 to 28. These tips were employed for evaluating cutting performance by the cutting conditions 1 and 2 similarly to Example 1, and chipping performance was tested by the cutting condition 3 similarly to Example 2. These results are shown together in Table 6.

TABLE 6

| Sample | Structure of Hard Coating Layer | Wear Resistance Cutting Condition 1 | Wear Resistance Cutting Condition 2 | Chipping Resistance Cutting Condition 3 |
|---|---|---|---|---|
| 22* | TiN(4)/$Al_2O_3$(10)/TiCN(2) | Chipped in 3 min. 5 sec. | chipped in 18 min. 3 sec. | 5 min. 2 sec. |
| 23 | TiN(4)/$Al_2O_3$(10)/TiCN(10) | 7 min. 24 sec. | 25 min. 14 sec. | 7 min. 15 sec. |
| 24 | TiN(4)/$Al_2O_3$(10)/TiCN(15) | 9 min. 28 sec. | 55 min.21 sec. | 6 min.39 sec. |
| 25 | TiN(4)/$Al_2O_3$(10)/TiCN(30) | 10 min. 31 sec. | 84 min. 53 sec. | 5 min. 56 sec. |
| 26 | TiN(4)/$Al_2O_3$(10)/TiCN(46) | 11 min. 23 sec. | 74 min.31 sec. | 5 min. 12 sec. |
| 27 | TiN(4)/$Al_2O_3$(10)/TiCN(95) | 10 min. 19 sec. | 63 min. 16 sec. | 3 min. 4 sec. |
| 28* | TiN(4)/$Al_2O_3$(10)/TiCN(120) | 6 min. 5 sec. | 52 min. 47 sec. | 1 min. 57 sec. |

As understood from the above results, the samples other than the sample 22 having a small film thickness of the outer layer of TiCN and the sample 28 having a large thickness exhibited cutting performance which is excellent in balance between wear resistance and chipping resistance, and the tips of the samples 24, 25 and 26 exhibited particularly excellent cutting performance above all.

From the results shown in Table 5 of the above Example 3 and Table 6 of Example 4, it is understood that the samples 16 to 19 and 24 to 26 in which total film thicknesses of the hard coating layers are within the range of 25 to 60 $\mu$m are particularly excellent in balance between wear resistance and chipping resistance.

EXAMPLE 5

Hard coating layers consisting of the structure identified by symbol I in the above Table 1 were formed on surfaces of the base materials 1 in the above Example 1, to prepare tips of samples 29 to 34. The shapes of crystal grains of TiCN layers of the outermost sides in these samples were varied by changing the film forming conditions. These tips were employed for evaluating cutting performance by the cutting condition 2 similarly to Example 1, and chipping performance was tested by the cutting conditions 3 similarly to Example 2. These results are shown together in Table 7.

TABLE 7

| Sample | Aspect Ratio of Crystals in TiCN Layer | Wear Resistance Cutting Condition 2 | Chipping Resistance Cutting Condition 3 |
|---|---|---|---|
| 29 | 1.5 | 51 min. 13 sec. | 3 min. 25 sec. |
| 30 | 5 | 70 min. 32 sec. | 5 min. 16 sec. |
| 31 | 15 | 79 min. 45 sec. | 7. min. 4. sec. |
| 32 | 35 | 85 min. 11 sec. | 8 min. 21 sec. |
| 33 | 70 | 78 min. 7 sec.. | 7 min. 36 sec. |
| 34 | 100 | 62 min. 24 sec. | 7 min. 54 sec. |

It is understood that the samples are excellent in wear resistance and chipping resistance when the aspect ratios of TiCN forming the TiCN layers on the outermost sides among the outer coating layers are within the range of 5 to 80, and the samples 31 and 32 exhibit particularly excellent performance above all.

EXAMPLE 6

When the C:N ratio of the TiCN layer which is the outer layer of the tip of the sample 1 (base material 1, hard coating layer A) prepared in the above Example 1 was calculated by obtaining the lattice constant through X-ray diffraction, it was found to be 4:6 in molar ratio. Then, TiCN layers having different C:N ratios shown in Table 8 were formed as outer layers by varying flow ratios of raw material gas while inner layers and intermediate layers were identical to the sample 1, thereby preparing tips of samples 35 to 38.

These tips were employed for evaluating cutting performance by the cutting conditions 1 and 2 similarly to Example 1, and chipping resistance was tested by the cutting condition 3 similarly to Example 2. These results are shown together in Table 8.

TABLE 8

| Sample | C:N Ratio of TiCN Layer | Wear Resistance Cutting Condition 1 | Wear Resistance Cutting Condition 2 | Chipping Resistance Cutting Condition 3 |
|---|---|---|---|---|
| 1 | 4:6 | 5 min. 11 sec. | 102 min. 17 sec. | 5 min. 22 sec. |
| 35 | 5:5 | 7 min. 23 sec. | 124 min. 32 sec. | 6 min. 13 sec. |
| 36 | 6:4 | 8 min. 54 sec. | 141 min. 8 sec. | 5 min. 54 sec. |
| 37 | 7:3 | 7 min. 42 sec. | 149 min. 44 sec. | 4 min. 57 sec. |
| 38 | 8:2 | 7 min. 21 sec.. | 137 min. 51 sec. | 3 min. 42 sec. |

From the above results, it is understood that the tips of the samples 35 to 37 whose C:N ratios are within the range of 5:5 to 7:3 in molar ratio are excellent in wear resistance and chipping resistance, and exhibit excellent cutting performance.

EXAMPLE 7

In case of forming the hard coating layers identified by symbol D of the above Table 1 on the surface of the base material 1, formation of the TiCN layer as a part of the outer layer was performed by employing $TiCl_4$ and $CH_3CN$ as a raw material gas and hydrogen gas as a carrier gas at a temperature of 1000° C. and a pressure of 50 Torr, thereby preparing a tip of a sample 39. Table 9 shows results of employing the obtained tip for evaluating cutting performance by the cutting conditions 1 and 2.

Further, Table 9 also shows results of similar evaluation as to the sample 4 prepared by forming a TiCN layer by ordinary CVD similarly to the above except that $TiCl_4$° $CH_4$ and nitrogen gas were employed as a raw material gas and hydrogen gas was employed as a carrier gas. From Table 9, it is understood that the sample 39 employing $CH_3CN$ as a raw material gas exhibits superior cutting performance.

TABLE 9

| Sample | Wear Resistance Cutting Condition 1 | Wear Resistance Cutting Condition 2 |
|---|---|---|
| 4 | 18 min. 39 sec. | 75 min. 51 sec. |
| 39 | 24 min. 51 sec. | 103 min. 14 sec. |

EXAMPLE 8

Corresponding generally with the tip of the sample 11 of the above Example 2, tips of samples 40 to 45 were prepared with thin films having a thickness of about 0.5 $\mu$m and consisting of TiBN, TiBNO, TiNO, TiCO, TiCNO, or $TiO_2$ provided between intermediate layers of $Al_2O_3$ and outer layers of TiCN by ordinary CVD at 1000°. As a raw material gas, $TiCl_4$, $CH_4$, $N_2$, $H_2$, CO, $NH_3$ and $BCl_3$ were used in response to or depending on the desired film qualities.

Results of evaluating wear resistance and chipping resistance as to the obtained respective tips are shown in Table 10 in comparison with the tip of the sample 11.

TABLE 10

| Sample | Thin Film | Wear Resistance Cutting Condition 2 | Chipping Resistance Cutting Condition 3 |
|---|---|---|---|
| 11 | no | 89 min. 33 sec. | 5 min. 41 sec. |
| 40 | TiBN | 131 min. 17 sec. | 7 min. 15 sec. |
| 41 | TiBNO | 125 min. 23 sec. | 7. min. 4. sec. |
| 42 | TiNO | 108 min. 5 sec. | 6 min. 35 sec. |
| 43 | TiCO | 133 min. 41 sec.. | 6 min. 52 sec. |
| 44 | TiCNO | 147 min. 59 sec. | 7 min. 29 sec. |
| 45 | $TiO_2$ | 102 min 31 sec. | 6 min. 19 sec. |

From the results, it is understood that the samples 40 to 45 including the thin films consisting of TiBN, TiBNO, TiNO, TiCO, TiCNO, or $TiO_2$ between the intermediate layers of $Al_2O_3$ and the outer layers of TiCN exhibit superior cutting performance as compared to the sample 11 that was not provided with these thin films.

EXAMPLE 9

Corresponding generally to the tip of the sample 25 of the above Example 4, tips of samples 46 to 47 were prepared with thin films having a thickness of about 0.5 $\mu$m and consisting of AlN or AlON provided between intermediate layers of $Al_2O_3$ and outer layers of TiCN by ordinary CVD at 1000° C. As a raw material gas, $AlCl_{41}$ $CO_2$, $N_2$ and $H_2$ were used in response to or depending on the desired film qualities. Results of evaluating wear resistance and chipping resistance as to the obtained respective tips are shown in Table 11 in comparison with the tip of the sample 25.

TABLE 11

| Sample | Thin Film | Wear Resistance Cutting Condition 2 | Chipping Resistance Cutting Condition 3 |
|---|---|---|---|
| 25 | none | 84 min. 54 sec. | 5 min. 56 sec. |
| 46 | AlN | 145 min. 21 sec. | 7 min. 19 sec. |
| 47 | AlON | 151 min. 39 sec. | 7 min. 2 sec. |

From the above results, it is understood that the samples 46 to 47 including the thin films consisting of AlN or AlON between the intermediate layers of $Al_2O_3$ and the outer layers of TiCN exhibit excellent cutting performance as compared with the sample 25 that was not provided with these thin films.

EXAMPLE 10

Corresponding generally with the tip of the sample 25 of the above Example 4, samples 46-c and 47-c were prepared having additional layers which had a thickness of about 0.5 μm and compositions that were continuously changed or varied from $Al_2O_3$ to AlN, or from $Al_2O_3$ to AlON, provided between intermediate layers of $Al_2O_3$ and outer layers of TiCN. These layers were prepared by employing ordinary CVD and continuously reducing the raw material gas ratios Of $CO_2/N_2$ while continuously changing the temperatures from 900° C. to 1000° C. Results of employing the obtained tips for evaluating the wear resistance and chipping resistance thereof are shown in Table 12, in comparison with the samples 46 and 47 with layers whose compositions are not continuously changed.

TABLE 12

| Sample | Thin Film | Wear Resistance Cutting Condition 2 | Chipping Resistance Cutting Condition 3 |
|---|---|---|---|
| 46 | AlN | 145 min. 21 sec. | 7 min. 19 sec. |
| 47 | AlON | 181 min. 39 sec. | 7 min. 2 sec. |
| 46-c | $Al_2O_3$-AlN | 183 min. 13 sec. | 8 min. 14 sec. |
| 47-c | $Al_2O_{3\text{-}AlON}$ | 186 min. 11 sec. | 8 min. 9 sec. |

From the above results, it is understood that the samples 46-c and 47-c, in which the compositions of the thin films consisting of AlN or AlON between the intermediate layers of $Al_2O_3$ and the outer layers of TiCN, were continuously varied, exhibit further superior cutting performance as compared with the samples 46 and 47 having layers with constant non-varying compositions.

EXAMPLE 11

Corresponding generally to the sample 12 of the above Example 2, samples 12-1, 12-2, 12-3, 12-4, 12-5 and 12-6 coated with TiCN films having different crystal orientation properties were prepared by changing coating temperatures and gas composition ratios while coating i.e. applying the TiCN films. As to the obtained samples, results of evaluation of cutting performance are shown in Table 13.

TABLE 13

| Sample | Crystal Plane Showing Maximum Peak Strength in X-Ray Diffraction | Wear Resistance Cutting Condition 2 | Chipping Resistance Cutting Condition 3 |
|---|---|---|---|
| 12-1 | (111) | 112 min. 15 sec. | 5 min. 17 sec. |
| 12-2 | (422) | 124 min. 32 sec. | 5 min. 25 sec. |
| 12-3 | (311) | 115 min. 54 sec. | 5 min. 12 sec. |
| 12-4 | (220) | 63 min. 41 sec. | 4 min. 36 sec. |
| 12-5 | (420) | 75 min. 18 sec. | 4 min. 49 sec. |
| 12-6 | (331) | 71 min. 25 sec. | 4 min. 21 sec. |

the above results, it is understood that a coated hard metal having the maximum peak strength of X-ray diffraction on (111), (422) or (311) exhibits excellent cutting performance.

EXAMPLE 12

Coating layers in a structure of TiN (0.5 μm)/TiCN (3 μm)/TiBN (0.5 μm)/$ZrO_2$ (1 μm)/$Al_2O_3$ (15 μm)/AlON (0.5 μm)/TiCN (10 μm) were formed on the base materials 2 of the above Example 1 successively from inner layers. Film forming temperatures and gas composition ratios were varied while coating the TiCN films of the inner layers, to prepare samples 48-1, 48-2, 48-3, 48-4 and 48-5 with TiCN films having different aspect ratios of crystal grains. Table 14 shows evaluation results of cutting performance.

TABLE 14

| Sample | Aspect Ratio of Crystal Grain of Inner Layer TiCN | Wear Resistance Cutting Condition 1 | Chipping Resistance Cutting Condition 3 |
|---|---|---|---|
| 48-1 | 3 | 5 min. 15 sec. | 6 min. 7 sec. |
| 48-2 | 7 | 8 min. 21 sec. | 7 min. 21 sec. |
| 48-3 | 15 | 10 min. 34 sec. | 7 min. 52 sec. |
| 48-4 | 26 | 9 min. 27 sec. | 7 min. 35 sec. |
| 48-5 | 42 | 6 min. 18 sec.. | 6 min. 4 sec. |

From the above results, it is understood that samples 48-2, 48-3 and 48-4 in which the aspect ratios of the crystal grains are within the range of 5 to 30 in the TiCN films, which are the thickest layers among the inner layers, have excellent cutting performance.

EXAMPLE 13

In the sample 17 of the above Example 3, the crystal grain diameters of crystals in the $Al_2O_3$ films were varied by changing film forming conditions (coating temperature and gas composition ratio), for preparing samples 17-1, 17-2, 17-3, 17-4 and 17-5 with $Al_2O_3$ films having different aspect ratios of crystal grains. Evaluation results of cutting performance are shown in Table 15.

TABLE 15

| Sample | Aspect Ratio of $Al_2O_3$ Crystal Grain | Wear Resistance Cutting Condition 1 | Chipping Resistance Cutting Condition 3 |
|---|---|---|---|
| 17-1 | 1 | 12 min. 10 sec. | 5 min. 41 sec. |
| 17-2 | 3 | 12 min. 3 sec. | 7 min. 33 sec. |
| 17-3 | 8 | 12 min. 21 sec. | 8. min. 5 sec. |
| 17-4 | 17 | 12 min. 15 sec. | 7 min. 21 sec. |
| 17-5 | 25 | 11 min. 50 sec.. | 6 min. 3 sec. |

From the above results, it is understood that the tips of Samples 17-2, 17-3 and 17-4, in which the aspect ratios of the crystal grains in the $Al_2O_3$ films of the intermediate layers were within the range of 3 to 20, have excellent cutting performance.

EXAMPLE 14

In samples generally corresponding to the sample 47 of the above Example 9, the crystal systems of $Al_2O_3$ of intermediate layers were varied by changing the coating temperature and the gas composition ratio, for preparing two types of samples having different crystal systems. As to the obtained samples, evaluation results of cutting performance are shown in Table 16.

TABLE 16

| Sample | Crystal System of $Al_2O_3$ | Wear Resistance Cutting Condition 2 | Chipping Resistance Cutting Condition 3 |
|---|---|---|---|
| 47 | mainly composed of κ | 151 min. 39 sec. | 7 min. 24 sec. |
| 47-1 | mainly composed of α | 162 min. 15 sec. | 8 min. 17 sec. |

From the above results, it is understood that excellent cutting performance can be attained by providing the crystal system of $Al_2O_3$ of the intermediate layer to be mainly composed of an a type.

EXAMPLE 15

Corresponding generally to the tip of the sample 47-1 of Example 14, a sample 47-m was prepared in which only a portion of the intermediate layer of about 1.0 μm in thickness being in contact with the inner layer and a portion of the intermediate layer of about 1 μm in thickness being in contact with the outer layer were mainly composed of κ-$Al_2O_3$, while a portion of the intermediate layer located between the outer κ-$Al_2O_3$ portions was mainly composed of α-$Al_2O_3$. The $Al_2O_3$ intermediate layer having such a crystal system was prepared with a raw material gas of $H_2$, $CO_2$ and $AlC_3$. Formation of the κ-$Al_2O_3$ was performed under conditions of 950° C., 50 Torr and $CO_2$ =2%, and formation of α-$Al_2O_3$ was performed under conditions of 1050° C., 50 Torr and $CO_2$ =5%. Between the formation of the κ-$Al_2O_3$ layer and the formation of the α-$Al_2O_3$ layer, the degree of vacuum was increased to not more than $10^{-3}$ Torr. Results of employing a tip thus prepared and evaluating the same as to wear resistance and chipping resistance are shown in Table 17.

TABLE 17

| Sample | Crystal System of $Al_2O_3$ | Wear Resistance Cutting Condition 2 | Chipping Resistance Cutting Condition 3 |
|---|---|---|---|
| 47-l | mainly composed of α | 162 min. 15 sec. | 8 min. 17 sec. |
| 47-m | mainly composed of κ − α − κ | 175 min. 23 sec. | 8 min. 31 sec. |

EXAMPLE 16

Generally corresponding to the sample 23 of Example 4, samples were prepared in which crystal orientation properties of $Al_2O_3$ films of intermediate layers were varied by controlling the coating temperatures and the gas composition ratios. As to obtained samples 23-1, 23-2, 23-3, 23-4 and 23-5, evaluation results of cutting performance are shown in Table 18.

TABLE 18

| Sample | Crystal Plane Showing Maximum Peak Strength in X-Ray Diffraction | Wear Resistance Cutting Condition 2 | Chipping Resistance Cutting Condition 3 |
|---|---|---|---|
| 23-1 | (104) | 52 min. 21 sec. | 8 min. 4 sec. |
| 23-2 | (116) | 42 min. 33 sec. | 7 min. 52 sec. |
| 23-3 | (113) | 25 min. 14 sec. | 7 min. 15 sec. |
| 23-4 | (024) | 28 min. 17 sec. | 6 min. 59 sec. |
| 23-5 | (300) | 26 min. 22 sec. | 7 min. 3 sec. |

From the above results, it is understood that a coated hard metal in which an $Al_2O_3$ film of an intermediate layer has the maximum peak strength of X-ray diffraction as to a crystal plane of (104) or (116) exhibits excellent cutting performance.

EXAMPLE 17

Coating films in a structure of TiN (0.5 μm)/TiCN (3 μm)/TiBN (0.5 μm)/$Al_2O_3$ (15 μm)/AlON (0.5 μm)/TiCN (10 μm) were formed on the base materials 2 of Example 1 successively from inner layers. Film forming temperatures and gas composition ratios were changed, to vary the crystal grain sizes of TiCN of the inner layers, $Al_2O_3$ Of intermediate layers, and TiCN of outer layers. A sample 48-6 in which the aspect ratios of TiCN crystal grain sizes of the inner layer and the outer layer were larger than the aspect ratio of intermediate layer $Al_2O_3$ crystal grains by at least twice, and a sample 48-7, in which these aspect ratios differed by not more than twice were prepared. Distances between cracks in the coating layers caused by the crystal grains in these samples were measured by observing the same with an optical microscope after mirror-polishing sample sections. The distances between the cracks were obtained by performing 5 visual field measurements with a magnification of 500 times. The results are shown in Table 19. Cutting performance results of the obtained samples are also shown in Table 19.

TABLE 19

| Sample | Crack Distance of Inner Layer TiCN (μm) | Crack Distance of Outer Layer TiCN (μm) | Crack Distance of Intermediate Layer $Al_2O_3$ (μm) | Wear Resistance Cutting Condition 1 | Chipping Resistance Cutting Condition 3 |
|---|---|---|---|---|---|
| 48-6 | 80 | 70 | 100 | 12 min. 45 sec. | 8 min. 4 sec. |
| 48-7 | 100 | 100 | 100 | 10 min. 11 sec. | 7 min. 32 sec. |

From the above results, it is understood that a coated hard metal having crack distances of an inner layer and an outer layer smaller than crack distances of an intermediate layer of coating layers exhibits excellent cutting performance.

EXAMPLE 18

Generally corresponding to the samples 24 of Example 4, samples 24-1, 24-2 and 24-3 were prepared to have substantially vertical cracks introduced into the coating layers by a centrifugal-barrel treatment after coating treatments. As to these samples, cutting performance is shown in Table 20.

TABLE 20

| Sample | Crack Distance of Coating Layer (μm) | Wear Resistance Cutting Condition 2 | Chipping Resistance Cutting Condition 3 |
|---|---|---|---|
| 24 | 72 | 55 min. 21 sec. | 6 min. 39 sec. |
| 24-1 | 38 | 59 min. 42 sec. | 7 min. 41 sec. |
| 24-2 | 25 | 63 min. 17 sec. | 7 min. 58 sec. |
| 24-3 | 16 | 56 min. 3 sec. | 6 min. 48 sec. |

By the above results, it is understood that a coated hard metal having crack distances of coating layers within the range of 20 to 40 μm has excellent cutting performance. The method of introducing cracks can be carried out by a treatment with a shot blast or an elastic grindstone, a quench treatment or the like, in place of the barrel treatment. These crack distances need not be formed on the overall coating layers, but rather a hard coated metal exhibiting excellent cutting performance is also obtained when cracks are formed at crack distances within this range only on a ridge portion of an insert.

EXAMPLE 19

Hard layers shown in Table 21 were further coated onto tip surfaces of the sample 31 of Example 5, to prepare tips of samples 31-1 to 31-5. These tips were employed for performing a cutting test under the cutting conditions 1 and 2 similarly to Example 1. Evaluation results are shown in Table 21.

TABLE 21

| Sample | Structure of Hard Coating Layer | Wear Resistance Cutting Condition 1 | Chipping Resistance Cutting Condition 2 |
|---|---|---|---|
| 31 | I of Table 1 | 4 min. 57 sec. | 79 min. 45 sec. |
| 31-1 | I/$Al_2O_3$(2)/TiN(0.5) | 6 min. 39 sec. | 81 min. 33 sec. |
| 31-2 | I/TiBN(0.5)/$Al_2O_3$(1) | 6 min. 7 sec. | 84 min. 16 sec. |
| 31-3 | I/$ZrO_2$(1) | 5 min. 45 sec. | 82 min. 51 sec. |
| 31-4 | I/TiCN(0.5)/$Al_2O_3$(3)/TiN(0.5) | 7 min. 28 sec. | 78 min. 27 sec. |
| 31-5 | I/HfCN(0.5)$HfO_2$(1) | 6 min. 54 sec. | 83 min. 48 sec. |

As understood from the above results, the samples further having oxide thin films of $Al_2O_3$, $ZrO_2$, $HfO_2$ etc. and/or TiN coated on the outer layers of TiCN are excellent in wear resistance in high-speed cutting in particular.

EXAMPLE 20

Generally corresponding to the tip of the sample 44 of Example 8, samples 44-1, 44-2 and 44-3 in which coatings were partially ground off or removed from ridge portions of the inserts by an elastic grindstone were prepared. Average values of surface roughness Ra of the ground portions and cutting performance of the obtained samples are shown in Table 22.

TABLE 22

| Sample | Average Value of Surface Roughness Ra in Removed Coating Portion ($\mu$m) | Wear Resistance Cutting Condition 1 | Chipping Resistance Cutting Condition 3 |
|---|---|---|---|
| 44 | 0.065 | 147 min. 59 sec. | 7 min. 29 sec. |
| 44-1 | 0.048 | 171 min. 42 sec. | 8 min. 5 sec. |
| 44-2 | 0.041 | 183 min. 25 sec. | 8 min. 34 sec. |
| 44-3 | 0.030 | 188 min. 56 sec. | 8 min. 21 sec. |

The average values of surface roughness Ra were measured by enlarging the insert ridge portions to 5000 times in ERA 8000 by ELIONIX INC. The average value of surface roughness Ra mentioned here is the average value of surface roughness Ra as to 180 horizontal lines of the measurement field. From the above results, it is understood that a coated hard metal in which the average value of surface roughness Ra of a coating on a ridge portion of an insert is not more than 0.05 $\mu$m exhibits excellent cutting performance.

EXAMPLE 21

ISO M20 cemented carbide (base material 1), ISO K20 (base material 2), and a commercially available cermet tool material (base material 3) were prepared as base materials, and each of hard coating layers shown in Table 23 was formed on each base material by well-known chemical vapor deposition at a deposition temperature of 1000° C., for preparing tip-shaped tools according to SNGN120408 respectively.

TABLE 23

| Symbol | Structure of Hard Coating Layer (left side = base material side, number in parenthesis = film thickness $\mu$m)) |
|---|---|
| A' | TiN(0.5)/$ZrO_2$(3)/TiCN(15) |
| B' | TiC(0.5)/TiCN(3)/TiBN(0.5)/$ZrO_2$(1)/TiN(7) |

TABLE 23-continued

| Symbol | Structure of Hard Coating Layer (left side = base material side, number in parenthesis = film thickness $\mu$m)) |
|---|---|
| C' | TiCN(2)/TiCO(0.5)/$ZrO_2$(5)/TiCN(20) |
| D' | TiN(0.5)/TiCNO(0.5)/$ZrO_2$(18)/TiCN(30)/TiC(10) |
| E' | $ZrO_2$(3)/TiCN(15) |
| F' | TiN(0.5)/$ZrO_2$(0.3)/TiCN(15) |
| G' | TiN(0.5)/TiCN(15)/$ZrO_2$(3) |
| H' | TiN(0.5)/$ZrO_2$(3) |
| I' | TiN(1)/TiBN(0.5)/$ZrO_2$(3)/TiC(0.5)/TiCN(10) |

(Note) In relation to the structures of the hard coating layers in Table 23, the fact that the left sides are base material sides and the numbers in parentheses indicate film thicknesses ($\mu$m) also applies to the following Tables.

The respective tips forming the hard coating layers on the base materials were employed for cutting workpieces of SCM415 under cutting conditions of the following Table 24, and cutting performance was evaluated. The results are shown in Table 25, along with the combinations of the base materials and the hard coating layers.

TABLE 24

| Cutting Condition | Cutting Speed (m/min) | Feed Rate (mm/rev) | Depth of Cut (mm) | Cutting Oil | Holder | Life Criterion |
|---|---|---|---|---|---|---|
| 1 | 500 | 0.5 | 1.5 | no | FN11R44A | $V_B$ = 0.15 mm |
| 2 | 200 | 0.4 | 1.5 | yes | FN11R44A | $V_B$ = 0.15 mm |
| 3 | 100 | 0.3 | 1.5 | no | FN11R44A | chipping |

TABLE 25

| Sample | Base Material | Coating Layer | Cutting Performance: Cutting Condition 1 | Cutting Performance: Cutting Condition 2 |
|---|---|---|---|---|
| 1' | 1 | A' | 5 min. 27 sec. | 99 min. 52 sec. |
| 2' | 2 | B' | 3 min. 41 sec. | 46 min. 19 sec. |
| 3' | 3 | C' | 9 min. 33 sec. | 91. min. 12. sec. |
| 4' | 1 | D' | 17 min. 26 sec. | 70 min. 40 sec. |
| 5'* | 1 | E' | separated in 38 sec. | separated in 1 min. 31 sec. |
| 6'* | 1 | F' | chipped in 59 sec. | 84 min. 17 sec. |
| 7'* | 1 | G' | chipped in 43 sec. | 17 min. 10 sec. |
| 8'* | 1 | H' | chipped in 25 sec. | chipped in 1 min. 24 sec. |

*designates comparative example throughout the Tables

From the above results, it is understood that the tips of the samples 1' to 4' of inventive Example exhibit excellent cutting performance not only in high-speed cutting (cutting condition 1) but also in low-speed cutting (cutting condition 2). By comparison of the samples 1' and 5', an effect of having a Ti compound as an inner layer is understood. From comparison of the samples 1' and 6', it is understood that the improved effect is small if the film thickness of the $ZrO_2$ intermediate layer is 0.3 $\mu$m, while it is understood from comparison of the samples 1' and 7' that $ZrO_2$ is superior in wear resistance when the same is employed as an intermediate layer rather than being coated as an outer layer. By comparison of the samples 1' and 8', it is understood that the Ti compound is superior in wear resistance to $ZrO_2$ as an outer layer.

EXAMPLE 22

Hard coating layers shown in the following Table 26 were formed on the surfaces of the base materials 1 in the above Example 21, to prepare tips of samples 9' to 14'. These tips were employed for evaluating cutting performance by the cutting condition 2 similarly to Example 21. As shown in FIG. 9, the workpiece 7 consisting of SCM435 having four grooves 8 on its circumference was employed to test chipping resistance by the cutting condition 3 of the above Table 25. The chipping resistance was evaluated by cutting times up to chipping of the tips. These results are shown together in Table 26.

TABLE 26

| Sample | Structure of Hard Coating Layer | Wear Resistance Cutting Condition 2 | Chipping Resistance Cutting Condition 3 |
|---|---|---|---|
| 9'* | $ZrO_2$(3)/TiCN(15) | Separated in 1 min. 49 sec. | 3 min. 11 sec. |
| 10' | TiC(0.2)/$ZrO_2$(3)/TiCN(15) | 67 min. 45 sec. | 5 min. 7 sec. |
| 11' | TiC(0.5)/$ZrO_2$(3)/TiCN(15) | 91 min. 27 sec. | 6 min. 50 sec. |
| 12' | TiC(3)/$ZrO_2$(3)/TiCN(15) | 113 min. 21 sec. | 6 min. 24 sec. |
| 13' | TiC(5)/$ZrO_2$(3)/TiCN(15) | 97 min. 14 sec. | 5 min. 59 sec. |
| 14'* | TiC(10)/$ZrO_2$(3)/TiCN(15) | 88 min. 5 sec. | 4 min. 33 sec. |

As understood from the above results, the sample 9' having no Ti compound as an inner layer suffered separation of the coating layers in an early stage in a wear resistance test since adhesion of the coating layers was low, and had an extremely short life. The tip of the sample 14' exhibited a slightly inferior chipping resistance since the film thickness of the inner layer was large, while the same is excellent as to wear resistance. On the other hand, the samples 10' to 13' of the inventive Example are excellent in wear resistance and chipping resistance, while the samples 11' and 12' are excellent in balance between wear resistance and chipping resistance in particular.

EXAMPLE 23

Hard coating layers shown in the following Table 27 were formed on surfaces of the base materials 2 in the above Example 21, to prepare tips of samples 15' to 21'. These tips were employed to evaluate cutting performance by the cutting condition 1 similarly to Example 21. Further, chipping resistance was tested by the cutting condition 3, similarly to Example 22. These results are shown together in Table 27.

TABLE 27

| Sample | Structure of Hard Coating Layer | Wear Resistance Cutting Condition 1 | Chipping Resistance Cutting Condition 3 |
|---|---|---|---|
| 15'* | TiCN(2)/$ZrO_2$(0.3)/TiC(13) | Chipped in 2 min. 18 sec. | 7 min. 19 sec. |
| 16' | TiCN(2)/$ZrO_2$(0.5)/TiC(13) | 8 min. 22 sec. | 8 min. 51 sec. |
| 17' | TiCN(2)/$ZrO_2$(3)/TiC(13) | 13 min. 37 sec. | 9 min. 25 sec. |
| 18' | TiCN(2)/$ZrO_2$(10)/TiC(13) | 15 min. 41 sec. | 8 min. 31 sec. |
| 19' | TiCN(2)/$ZrO_2$(15)/TiC(13) | 14 min. 18 sec. | 8 min. 17 sec. |
| 20' | TiCN(2)/$ZrO_2$(20)/TiC(13) | 12 min. 34 sec. | 7 min. 15 sec. |
| 21'* | TiCN(2)/$ZrO_2$(30)/TiC(13) | 11 min. 16 sec. | 6 min. 8 sec. |

As understood from the above results, the samples other than the sample 15' having a small film thickness of the intermediate layer of $ZrO_2$ and the sample 21' having a large thickness exhibited cutting performance which is excellent in balance between wear resistance and chipping resistance, and the tips of the samples 17', 18' and 19' exhibited particularly excellent cutting performance above all.

EXAMPLE 24

Hard coating layers shown in the following Table 28 were formed on the surfaces of the base materials 3 in Example 21, to prepare tips of samples 22' to 28'. These tips were employed to evaluate cutting performance by the cutting conditions 1 and 2 similarly to Example 21, and chipping resistance was tested by the cutting condition 3 similarly to Example 22. These results are shown together in Table 28.

TABLE 28

| Sample | Structure of Hard Coating Layer | Wear Resistance Cutting Condition 1 | Wear Resistance Cutting Condition 2 | Chipping Resistance Cutting Condition 3 |
|---|---|---|---|---|
| 22'* | TiN(4)/$ZrO_2$(3)/TiCN(2) | Chipped in 1 min. 12 sec. | chipped in 8 min. 12 sec. | 9 min. 47 sec. |
| 23' | TiN(4)/$ZrO_2$(3)/TiCN(10) | 4 min. 15 sec. | 22 min. 39 sec. | 8 min. 41 sec. |
| 24' | TiN(4)/$ZrO_2$(3)/TiCN(15) | 5 min. 49 sec. | 53 min. 10 sec. | 7 min. 58 sec. |
| 25' | TiN(4)/$ZrO_2$(3)/TiCN(30) | 7 min. 3 sec. | 85 min. 14 sec. | 6 min. 35 sec. |
| 26' | TiN(4)/$ZrO_2$(3)/TiCN(46) | 6 min. 11 sec. | 72 min. 51 sec. | 6 min. 7 sec. |
| 27' | TiN(4)/$ZrO_2$(3)/TiCN(95) | 5 in. 20 sec. | 65 min. 32 sec. | 3 min. 29 sec. |
| 28'* | TiN(4)/$ZrO_2$(3)/TiCN(120) | 3 min. 5 sec. | 49 min 8 sec. | 2 min. 36 sec. |

As understood from the above results, the samples other than the sample 22' and the sample 28' having small and large film thicknesses of outer layers of TiCN exhibited cutting performance which is excellent in balance between wear resistance and chipping resistance, and the tips of the samples 24', 25' and 26' exhibited particularly excellent cutting performance above all.

From the results of the above Example 23 shown in Table 27 and Example 24 shown in Table 28, it is understood that the samples 18' to 19' and 24' to 26' in which the total film thicknesses of the hard coating layers are in the range of 20 to 60 $\mu$m are particularly excellent in balance between wear resistance and chipping resistance.

EXAMPLE 25

Hard coating layers consisting of the structure designated by symbol I' in the above Table 23 were formed on the surfaces of the base materials 1 in the above Example 21, to prepare tips of samples 29' to 34'. The shapes of crystal grains of the outermost TiCN layers in these samples were varied by changing the film forming conditions. These tips were employed to evaluate cutting performance by the cutting condition 2 similarly to Example 21, and chipping resistance was tested by the cutting condition 3 similarly to Example 22. These results are shown together in Table 29.

TABLE 29

| Sample | Aspect Ratio of Crystals TiCN Layer | Wear Resistance Cutting Condition 2 | Chipping Resistance Cutting Condition 3 |
|---|---|---|---|
| 29' | 1.5 | 48 min. 21 sec. | 4 min. 9 sec. |
| 30' | 5 | 72 min. 44 sec. | 6 min. 11 sec. |
| 31' | 15 | 81 min. 9 sec. | 7 min. 59 sec. |
| 32' | 35 | 86 min. 12 sec. | 9 min. 5 sec. |
| 33' | 70 | 78 min. 37 sec. | 8 min. 21 sec. |
| 34' | 100 | 60 min. 11 sec. | 8 min. 5 sec. |

It is understood that the samples are excellent in wear resistance and chipping resistance when the aspect ratios of TiCN crystal grains forming the outermost TiCN layers among the outer coating layers are in the range of 5 to 80, and the samples 31' and 32' exhibit particularly excellent performance above all.

EXAMPLE 26

When the C:N ratio of the TiCN layer which is the outer layer of the tip of the sample 1' (base material 1, hard coating layer A') prepared in the above Example 21 was calculated by obtaining the lattice constant by an X-ray diffraction method, it was 4:6 in molar ratio. Then, TiCN layers of different C:N ratios shown in Table 30 were formed as outer layers by varying the flow ratios of the raw material gas while inner layers and intermediate layers were identical to the sample 1', thereby preparing tips of samples 35' to 38'.

These tips were employed to evaluate cutting performance by the cutting conditions 1 and 2 similarly to Example 21, and chipping resistance was tested by the cutting condition 3 similarly to Example 22. These results are shown together in Table 30.

TABLE 30

| Sample | C:N Ratio of TiCN Layer | Wear Resistance Cutting Condition 1 | Wear Resistance Cutting Condition 2 | Chipping Resistance Cutting Condition 3 |
|---|---|---|---|---|
| 1' | 4:6 | 5 min. 27 sec. | 99 min. 52 sec. | 5 min. 59 sec. |
| 35' | 5:5 | 8 min. 5 sec. | 127 min. 24 sec. | 6 min. 56 sec. |
| 36' | 6:4 | 9 min. 17 sec. | 140 min. 15 sec. | 6 min. 28 sec. |
| 37' | 7:3 | 8 min. 31 sec. | 157 min. 18 sec. | 5 min. 31 sec. |
| 38' | 8:2 | 7 min. 42 sec.. | 128 min. 9 sec. | 4 min. 20 sec. |

From the above results, it is understood that the tips of the samples 35' to 37' having the C:N molar ratios in the range of 5:5 to 7:3 are excellent in wear resistance and chipping resistance, and exhibit excellent cutting performance.

EXAMPLE 27

For forming the hard coating layer designated by symbol D' in the above Table 23 on the surface of the base material 1, the TiCN layer among or as part of the outer layer was formed by employing $TiCl_4$ and $CH_3CN$ as a raw material gas and hydrogen gas as a carrier gas at a temperature of 1000° C. and under a pressure of 50 Torr, to prepare a tip of a sample 39'. Results of evaluating the cutting performance of the obtained tip by the cutting conditions 1 and 2 are shown in Table 31.

Table 31 also shows results of similar evaluation as to the sample 4' prepared by forming a TiCN layer by ordinary CVD similarly to the above except that $TiCl_{41}$ $CH_4$ and nitrogen gas were employed as a raw material gas and hydrogen gas was employed as a carrier gas. From Table 31, it is understood that the sample 39' employing $CH_3CN$ as the raw material gas exhibits superior cutting performance.

TABLE 31

| Sample | Wear Resistance Cutting Condition 1 | Wear Resistance Cutting Condition 2 |
|---|---|---|
| 4' | 17 min. 26 sec. | 70 min. 40 sec. |
| 39' | 28 min. 15 sec. | 111 min. 9 sec. |

EXAMPLE 28

Generally corresponding to the tip of the sample 11' of the above Example 22, tips of samples 40' to 45' were prepared having thin films, with a thickness of about 0.5 $\mu$m and consisting of TiBN, TiBNO, TiNO, TiCO, TiCNO or $TiO_2$ between intermediate layers of $ZrO_2$ and outer layers of TiCN formed by ordinary CVD at 1000° C. As to a raw material gas, $TiCl_4$, $CH_4$, $N_2$, $H_2$, CO, $NH_3$ and $BCl_3$ were used in response to or depending on the desired film qualities. Results of evaluation of wear resistance and chipping resistance as to the obtained respective tips are shown in Table 32 in comparison with the tip of the sample 11'.

TABLE 32

| Sample | Thin Film | Wear Resistance Cutting Condition 2 | Chipping Resistance Cutting Condition 3 |
|---|---|---|---|
| 11' | no | 91 min. 27 sec. | 6 min. 50 sec. |
| 40' | TiBN | 123 min. 7 sec. | 7 min. 24 sec. |
| 41' | TiBNO | 115 min. 43 sec. | 7 min. 18 sec. |
| 42' | TiNO | 112 min. 14 sec. | 6 min. 49 sec. |
| 43' | TiCO | 125 min. 51 sec.. | 6 min. 3 sec. |
| 44' | TiCNO | 36 min. 21 sec. | 7 min. 6 sec. |
| 45' | $TiO_2$ | 109 min. 32 sec. | 6 min. 31 sec. |

From the results, it is understood that the samples 40' to 45' having the thin films consisting of TiBN, TiBNO, TiNO, TiCO, TiCNO or $TiO_2$ between the intermediate layers of $ZrO_2$ and the outer layers of TiCN exhibit superior cutting performance as compared to the sample 11' which did not have these thin films.

EXAMPLE 29

Generally corresponding to the tip of the sample 25' of the above Example 24, tips of samples 46' to 51' were prepared having thin films with a thickness of about 0.5 $\mu$m and consisting of ZrC, ZrCN, ZrN, ZrCO, ZrCNO and ZrNO between intermediate layers of $ZrO_2$ and outer layers of TiCN formed by ordinary CVD at 1000° C. As to a raw material gas, $ZrCl_4$, $CO_2$, $N_2$ and $H_2$ were used in response to or depending on the desired film qualities. Results of evaluation of wear resistance and chipping resistance as to the obtained respective tips are shown in Table 33 in comparison with the tip of the sample 25'.

TABLE 33

| Sample | Thin Film | Wear Resistance Cutting Condition 2 | Chipping Resistance Cutting Condition 3 |
|---|---|---|---|
| 25' | none | 85 min. 14 sec. | 6 min. 35 sec. |
| 46' | ZrC | 131 min. 12 sec. | 7 min. 19 sec. |
| 47' | ZrCN | 138 min. 41 sec. | 7 min. 28 sec. |
| 48' | ZrN | 125 min. 33 sec. | 7 min. 34 sec. |
| 49' | ZrCO | 142 min. 29 sec.. | 7 min. 9 sec. |
| 50' | ZrCNO | 135 min. 8 sec. | 7 min. 18 sec. |
| 51' | ZrNO | 121 min. 19 sec. | 7 min. 47 sec. |

From the above results, it is understood that the samples 46' to 51' having the thin films consisting of ZrC, ZrCN, ZrN, ZrCO, ZrCNO or ZrNO between intermediate layers of $ZrO_2$ and the outer layers of TiCN exhibit superior cutting performance as compared to the sample 25' not provided with these thin films.

EXAMPLE 30

Samples 52' to 54' were prepared generally corresponding to the tip of the sample 11' of the above Example 22 but having an intermediate layer of $Al_2O_3$ rather than $ZrO_2$ thereon. These tips were employed to cut SUS304 material under conditions of a cutting speed of 350 m/min., a feed rate of 0.5 mm/rev., and a depth of cut of 1.5 mm in a wet type condition for 20 minutes, for measuring amounts of plastic deformation and amounts of boundary wear. Chipping resistance under the cutting conditions of the above Table 24 was evaluated, and these results are shown in Table 34.

TABLE 34

| Sample | Intermediate Layer (μm) | Amount of Plastic Deformation (mm) | Amount of Boundary Wear (mm) | Chipping Resistance Cutting Condition 3 |
|---|---|---|---|---|
| 11' | $ZrO_2$(3) | 0 | 0.13 | 6 min. 50 sec. |
| 52' | $Al_2O_3$(3) | 0.07 | 0.32 | 6 min. 12 sec. |
| 53' | $Al_2O_3$(10) | 0.02 | 0.35 | 5 min. 53 sec. |
| 54' | $Al_2O_3$(20) | 0 | 0.41 | 5 min. 34 sec. |

(Note)
The numbers in parentheses indicate film thicknesses (μm).

From these results, it is understood that the tip of the sample 11' using $ZrO_2$ as the intermediate layer suffers a smaller amount of boundary wear as compared with the tips of the remaining samples using $Al_2O_3$ as the intermediate layers, suffers a smaller amount of plastic deformation than the sample 52' of the same film thickness, and is excellent also in chipping resistance.

EXAMPLE 31

Generally corresponding to the tip of the sample 25' of Example 24, additional samples were prepared having layers whose compositions were continuously changed from $ZrO_2$ to ZrN or from $ZrO_2$ to ZrNO formed between intermediate layers of $ZrO_2$ and outer layers of TiCN in thicknesses of about 0.5 μm. These layers were prepared by employing ordinary CVD, continuously changing temperatures from 900° C. to 1000° C. and continuously reducing raw material gas ratios Of $CO_2/N_2$. Thus, samples 48'-c and 51'-c whose contents of O and N in the films were continuously changed or varied were obtained. Results of evaluating wear resistance and chipping resistance by employing the obtained samples are shown in Table 35 in comparison with samples 48' and 51' whose compositions were not continuously changed or varied in the thin film.

TABLE 35

| Sample | Thin Film | Wear Resistance Cutting Condition 2 | Chipping Resistance Cutting Condition 3 |
|---|---|---|---|
| 48' | ZrN | 125 min. 33 sec. | 7 min. 34 sec. |
| 51' | ZrNO | 121 min. 19 sec. | 7 min. 47 sec. |
| 48'-c | $ZrO_2$—ZrN | 154 min. 25 sec. | 8. min. 16. sec. |
| 51'-c | $ZrO_2$—ZrNO | 150 min. 13 sec. | 8 min. 35 sec. |

From the above results, it is understood that the samples 48'-c and 51'-c having continuously varying compositions of the thin films exhibit further superior cutting performance as compared with the samples 48' and 51' whose compositions were uniform or non-varying in the samples having thin films consisting of ZrN or ZrNO formed between the intermediate layers of $ZrO_2$ and the outer layers of TiCN.

EXAMPLE 33

Hard layers shown in Table 36 were further coated on tip surfaces according to the sample 31' of the above Example 25, to prepare tips of samples 31'-l to 31'-5. These tips were employed for performing a cutting test under the cutting conditions 1 and 2 similarly to Example 21. These evaluation results are shown in Table 36.

TABLE 36

| Sample | Structure of Hard Coating Layer | Wear Resistance Cutting Condition 1 | Wear Resistance Cutting Condition 2 |
|---|---|---|---|
| 31' | I' of Table 23 | 5 min. 32 sec. | 81 min. 9 sec. |
| 31'-1 | I'/$Al_2O_3$(2)/TiN(0.5) | 7 min. 15 sec. | 83 min. 14 sec. |
| 31'-2 | I'/TiBN(0.5)/$Al_2O_3$(1) | 6 min. 49 sec. | 85 min. 46 sec. |
| 31'-3 | I'/$ZrO_2$(1) | 7 min. 5 sec. | 84 min. 28 sec. |

TABLE 36-continued

| Sample | Structure of Hard Coating Layer | Wear Resistance Cutting Condition 1 | Wear Resistance Cutting Condition 2 |
|---|---|---|---|
| 31'-4 | I'/TiCN(0.5)/$Al_2O_3$(3)/TiN(0.5) | 7 min. 38 sec. | 79 min. 31 sec. |
| 31'-5 | I'/HfCN(0.5)/$HfO_2$(1) | 7 min. 24 sec. | 82 min. 17 sec. |

As understood from the above results, the samples 31'-l to 31'-5 further having oxide thin films of $Al_2O_{31}$ $ZrO_2$ or $HfO_2$ and/or TiN coated on the outer layers of TiCN are excellent in wear resistance in high-speed cutting in particular. According to the present invention, it is possible to provide a coated hard metal having excellent wear resistance and chipping resistance. In particular, the present invention can provide a coated hard metal for a cutting tool which can sufficiently withstand employment not only in ordinary cutting conditions but in severe cutting conditions of a high speed or high efficiency under which the cutting edge temperature exceeds 1000° C.

The embodiments disclosed herein must be regarded as illustrative in all points and not restrictive. The scope of the present invention is not limited by the above description but is defined by the scope of the claims, and it is intended that all modifications and equivalents in the meaning and scope of the claims are included.

We claim:

1. A coated hard metal material for a cutting tool comprising a base material selected from the group consisting of cemented carbide and cermet, and a hard coating layer on a surface of said base material, wherein said hard coating layer comprises:

an inner layer that is arranged on said base material, that consists essentially of at least one layer of a material selected from the group consisting of a carbide, a nitride, a carbonitride, a carbo-oxide, a carbonitrogen oxide and a boronitride of Ti, and that has a thickness in the range from 0.1 to 5 μm, an intermediate layer that is arranged on said inner layer, that is mainly composed of an oxide selected from the group consisting of $Al_2O_3$, $ZrO_2$ and a mixture or a solid solution thereof in which one of $Al_2O_3$ and $ZrO_2$ predominates, and that has a thickness which is in the range from 5 to 50 μm when said intermediate layer is mainly composed of said A1203 and in the range from 0.5 to 20 μm when said intermediate layer is mainly composed of said $ZrO_2$, and an outer layer that is arranged on said intermediate layer, that consists essentially of at least one layer composed of TiCN, having a molar C:N ratio in the range of 5:5 to 7:3, and composed of columnar crystals having an aspect ratio in the range from 5 to 80, and that has a thickness in the range from 10 to 50μm.

2. The coated hard metal material in accordance with claim 1, wherein said thickness of said inner layer is in the range from 0.5 to 3 μm, said thickness of said intermediate layer is in the range from 10 to 40 μm when said intermediate layer is mainly composed of said $Al_2O_3$, and in the range from 3 to 15 μm when said intermediate layer is mainly composed of said $ZrO_2$, and a total of said thicknesses of said inner layer, said intermediate layer and said outer layer is 25 to 60 μm when said intermediate layer is mainly composed of said $Al_2O_3$, and 20 to 60 μm when said intermediate layer is mainly composed of said $ZrO_2$.

3. The coated hard metal material in accordance with claim 2, wherein said intermediate layer is mainly composed of said $Al_2O_3$, and further comprising an Al-containing thin film consisting essentially of a material selected from the group consisting of a nitride and an oxy-nitride of Al between said intermediate layer and said outer layer and in contact with said intermediate layer.

4. The coated hard metal material in accordance with claim 3, wherein said Al-containing thin film has a nitrogen content that is reduced as said film approaches said intermediate layer and an oxygen content that is increased as said film approaches said intermediate layer.

5. The coated hard metal material in accordance with claim 4, further comprising a second thin film consisting essentially of a material selected from the group consisting of TiBNO, TiNO and $TiO_2$ between said Al-containing thin film and said outer layer.

6. The coated hard metal material in accordance with claim 1, wherein said intermediate layer is mainly composed of said $ZrO_2$, and further comprising a Zr-containing thin film consisting essentially of a material selected from the group consisting of a carbide, a nitride, a carbo-nitride, a carbo-oxide, an oxy-nitride and a carbonitrogen oxide of Zr between said intermediate layer and said outer layer and in contact with said intermediate layer.

7. The coated hard metal material in accordance with claim 6, wherein said Zr-containing thin film has a nitrogen content that is reduced as said film approaches said intermediate layer and an oxygen content that is increased as said film approaches said intermediate layer.

8. The coated hard metal material in accordance with claim 7, further comprising a second thin film consisting essentially of a material selected from the group consisting of TiBNO, TiNO and $TiO_2$ between said Zr-containing thin film and said outer layer.

9. The coated hard metal material in accordance with claim 1, further comprising a thin film consisting essentially of a material selected from the group consisting of TiBN, TiCO and TiCNO arranged between said intermediate layer and said outer layer, wherein said intermediate layer is in contact with said outer layer through said thin film.

10. The coated hard metal material in accordance with claim 1, further comprising a thin film consisting essentially of a material selected from the group consisting of TiBNO, TiNO and $TiO_2$ between said intermediate layer and said outer layer, wherein said outer layer is in contact with said intermediate layer through said thin film.

11. The coated hard metal material in accordance with claim 1, wherein said intermediate layer is mainly composed of said $Al_2O_3$, which is mainly composed of $\alpha$-$Al_2O_3$.

12. The coated hard metal material in accordance with claim 11, wherein said $Al_2O_3$ of said intermediate layer has a maximum peak strength of X-ray diffraction as to a crystal plane selected from the group consisting of (104) and (116).

13. The coated hard metal material in accordance with claim 11, wherein said intermediate layer includes a first portion in contact with said inner layers a second portion in contact with said outer layer, and a third portion between said first and second portions, and wherein said $Al_2O_3$ in said first and second portions is mainly $\kappa$-$Al_2O_3$ and said $Al_2O_3$ in said third portion is mainly said $\alpha$-$Al_2O_3$.

14. The coated hard metal material in accordance with claim 1, wherein said hard coating layer has a plurality of cracks spaced from one another therein, and an average spacing distance between adjacent ones of said cracks is in the range from 20 to 40 $\mu$m.

15. The coated hard metal material in accordance with claim 1, wherein said hard coating layer has a plurality of cracks spaced from one another in said inner layer, said intermediate layer, and said outer layer, and an average spacing distance between said cracks in said inner layer and an average spacing distance between said cracks in said outer layer are each respectively smaller than an average spacing distance between said cracks in said intermediate layer.

16. The coated hard metal material in accordance with claim 1, further comprising a thin film arranged on said outer layer and consisting essentially of an oxide selected from the group consisting of $Al_2O_3$ $ZrO_2$ and $HfO_2$, and wherein said thin film is thinner than said intermediate layer.

17. The coated hard metal material in accordance with claim 1, having the shape of a cutting tool including a cutting edge, and wherein a part of said hard coating layer is removed at said cutting edge so that said cutting edge has a surface whose average value of surface roughness Ra is not more than 0.05 $\mu$m.

18. The coated hard metal material in accordance with claim 16, wherein said TiCN of said outer layer has a maximum peak strength of X-ray diffraction as to a crystal plane selected from the group consisting of (111), (422) and (311).

19. The coated hard metal material in accordance with claim 18, wherein said inner layer comprises a plurality of layers of which a thickest layer is mainly composed of columnar crystals having an aspect ratio in the range of 5 to 30.

20. The coated hard metal material in accordance with claim 19, wherein said intermediate layer includes a layer that is mainly composed of columnar crystals having an aspect ratio in the range of 3 to 20.

21. The coated hard metal material in accordance with claim 11, wherein said intermediate layer includes a layer that is mainly composed of columnar crystals having an aspect ratio in the range from 3 to 20.

22. The coated hard metal material in accordance with claim 16, wherein said thin film has a thickness in the range from 0.5 to 5 $\mu$m.

23. The coated hard metal material in accordance with claim 1, having a configuration of a cutting tip for a cutting tool.

24. The coated hard metal material in accordance with claim 1, wherein said thickness of said outer layer is in the range from greater than 10 m to 50 $\mu$m.

25. The coated hard metal material in accordance with claim 1, wherein said thickness of said outer layer is in the range from 15 to 50$\mu$m.

26. The coated hard metal material in accordance with claim 1, wherein a total of said thicknesses of said inner layer, said intermediate layer and said outer layer is at least 35 $\mu$m.

27. The coated hard metal material in accordance with claim 1, wherein said thickness of said intermediate layer and said thickness of said outer layer are each respectively greater than said thickness of said inner layer.

* * * * *

UNITED STATES PATENT AND TRADEMARK OFFICE
CERTIFICATE OF CORRECTION

PATENT NO. : 5,871,850

DATED : Feb. 16, 1999

INVENTOR(S) : Moriguchi et al.

It is certified that error appears in the above-identified patent and that said Letters Patent is hereby corrected as shown below:

Col. 5, line 37, after "therefore,", replace "Al $_2O_3$" by --$Al_2O_3$--.

Col. 7, line 6, after "of", replace "$Al_2O_{31}$" by --$Al_2O_3$,--.

Col. 8, line 35, after "to", replace "60°" by --6°--.

Col. 12, line 12, after "or", replace "$ZrO_2O_2$," by --$ZrO_2$,--.

Col. 13, TABLE 1, Col. 2, line 6, after "(45)", replace "ITiCN(30)/TiC(10)" by --/TiCN(30)/TiC(10)--;
Col. 2, line 7, replace "Al203(10)/TiCN(15)" by --$Al_2O_3$(10)/TiCN(15)--;

lines 18, 19, 20, 21: delete these entire lines.

Col. 15, TABLE 6, Col. 5, line 3, replace "5 min. 2 sec." by --8 min. 2 sec.--.

Col. 17, line 63, after "$TiCl_4$", replace "°" by --,--.

Col. 18, line 48, after "gas,", replace "$AlCl_{41}$" by --$AlCl_4$,--.

UNITED STATES PATENT AND TRADEMARK OFFICE
CERTIFICATE OF CORRECTION

PATENT NO. : 5,871,850

DATED : Feb. 16, 1999

INVENTOR(S) : Moriguchi et al.

It is certified that error appears in the above-identified patent and that said Letters Patent is hereby corrected as shown below:

Col. 19, TABLE 12, Col. 2, line 5, replace "$Al_2O_3$-$_{AlON}$" by --$Al_2O_3$-AlON--;
line 56, before "the" insert --From--.

Col. 20, line 67, after "an", replace "a type." by --α type.--.

Col. 21, line 12, after "and", replace "$AlC_3$." by --$AlCl_3$.--.

Col. 28, line 3, after "that", replace "$TiCl_{41}$" by --$TiCl_4$,--;
TABLE 32, Col. 3, line 7, replace "125 min. 51 sec." by --128 min. 51 sec.--;
line 8, replace "36 min. 21 sec." by --136 min. 21 sec.--.

Col. 31, line 47, after "said" replace "Al203" by --$Al_2O_3$--.

Col. 33, line 1, after "inner", replace "layers" by --layer,--.
line 23, after "of", replace "$Al_2O_3ZrO_2$" by --$Al_2O_3$, $ZrO_2$--.

Col. 34, line 22, after "than", replace "10 m" by --10 μm--.

Signed and Sealed this

Thirty-first Day of August, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,871,850

DATED : Feb. 16, 1999

INVENTOR(S) : Moriguchi et al.

It is certified that error appears in the above-indentified patent and that said Letters Patent is hereby corrected as shown below:

Col. 1, line 4 to 6:

replace "This application is a PCT 371 international application, having application Ser. No. PCT/JP95/02016, filed 2 Oct., 1995." by --This application is a 35 U.S.C. 371 national stage application of PCT international application PCT/JP95/02016, filed on 2 October 1995.--.

Signed and Sealed this

Twenty-sixth Day of October, 1999

*Attest:*

*Attesting Officer*

Q. TODD DICKINSON

*Acting Commissioner of Patents and Trademarks*